United States Patent [19]

Richards

[11] 4,036,564

[45] July 19, 1977

[54] CONCRETE PUMPING APPARATUS

[76] Inventor: John A. Richards, 1312 Olwyn Drive, Tustin, Calif. 92680

[21] Appl. No.: 167,959

[22] Filed: Aug. 2, 1971

[51] Int. Cl.[2] ..... F04B 17/00; F04B 19/02; F04B 15/02

[52] U.S. Cl. ..... 417/344; 417/469; 417/516; 417/900

[58] Field of Search ..... 417/342, 344, 345, 457, 417/469, 489, 516, 900; 92/169

[56] References Cited

U.S. PATENT DOCUMENTS

| | | | |
|---|---|---|---|
| 256,232 | 3/1882 | Manning, Jr. | 417/516 |
| 2,061,425 | 11/1936 | Karstens | 417/516 X |
| 2,667,841 | 2/1954 | Meader | 417/900 |
| 2,747,224 | 5/1956 | Koch et al. | 417/900 |
| 2,815,719 | 12/1957 | Mustillo et al. | 417/511 X |
| 3,266,433 | 8/1966 | Mason | 417/900 X |
| 3,298,322 | 1/1967 | Sherrod | 417/900 X |
| 3,327,634 | 6/1967 | Whiteman, Jr. | 417/317 |
| 3,429,267 | 2/1969 | Zinga | 417/900 X |
| 3,682,575 | 8/1972 | Guddal et al. | 417/900 X |

*Primary Examiner*—Carlton R. Croyle

*Assistant Examiner*—Leonard Smith

*Attorney, Agent, or Firm*—Harry W. F. Glemser

[57] ABSTRACT

A concrete hopper has a plurality of arcuate channels in its bottom portion, preferably lined with a resilient material, such as rubber. The hopper includes a discharge end with discharge outlets formed therein in communication with the channels. A sliding sleeve-piston combination is associated with each channel for segregating and discharging a portion of the concrete through its associated discharge outlet. In other words, the sleeves are alternately filled by moving them through the hopper, and the pistons are operated to force the concrete out of the sleeves. A slide valve assembly including a discharge nozzle for connecting to a discharge hose and a pair of wear plates controls the discharge of pumped concrete from the discharge outlets. Hydraulic control means are included which automatically program the sequential operation of the sliding sleeve-piston combinations and the sliding valve. The pumping apparatus is designed to prevent the crushing of rock during shifting of the slide valve by being constructed so that the ends of the pistons and sleeves when fully extended lie in the same plane as the wear faces of the valve wear plates.

21 Claims, 18 Drawing Figures

INVENTOR.
JOHN A. RICHARDS

BY
Huebner & Worrel

ATTORNEYS.

INVENTOR.
JOHN A. RICHARDS
BY Hubbell & Worrel
ATTORNEYS.

INVENTOR.
JOHN A. RICHARDS
BY
Huebner & Worrel
ATTORNEYS.

INVENTOR.
JOHN A. RICHARDS
BY
Hubbner & Wood
ATTORNEYS.

INVENTOR.
JOHN A. RICHARDS
BY Huebner & Worrel
ATTORNEYS.

INVENTOR.
JOHN A. RICHARDS
BY
Huebner & Worrel
ATTORNEYS.

INVENTOR.
JOHN A. RICHARDS
BY
Huebner & Worrel
ATTORNEYS.

CONCRETE PUMPING APPARATUS

BACKGROUND OF THE INVENTION

The present invention relates to pump, and more particularly to an improved pumping apparatus suitable for pumping plastic concrete, such as low or even zero slump concrete, and other similar materials and mixtures.

One common application for such a pumping apparatus is to pump plastic concrete to elevated levels, such as to the upper stories of a building being constructed, or to pump plastic concrete to other points which are inaccessible to trucks. Heretofore, various pumping devices have been devised to pump unset plastic concrete to remote locations. Most commercial forms of these pumps depend on gravity head and pressure differential for charging. As a consequence, they are unsuitable for use in pumping zero slump concrete and other similar mixes since zero slump concrete has a low water-cement ratio and generally will not flow under the influence of either gravity head or pressure differential. Thus, these prior art pumps are incapable of pumping zero slump concrete since the pump will not charge.

Other types of pumping apparatus, however, have been devised which have employed both fixed and sliding sleeves or cylinders and through which pistons are advanced to eject and thereby pump the plastic concrete. These pumping apparatuses have generally included a valve to control the flow of concrete through their discharge outlet, such a valve being necessary in operations where concrete is being pumped to an elevated location in order to prevent the backflow of concrete through the discharge hose between work strokes of the pumping mechanism.

Heretofore, the valves in these pumping apparatuses have generally have plagued by the problems of wear, mix separation and admission of air. Mix separation is the separation of the mix ingredients in the concrete being pumped and occurs whenever the pump valve does not completely close, i.e., remains partially open. When the valve fails to completely close, the mortar phase of the concrete mix tends to backflow into the pump with the result that a relatively dry pocket of coarse aggregate, a so called rock pocket, is formed in the discharge hose adjacent the valve. As the concrete is then pumped through the discharge hose, these rock pockets do not as readily flow through the discharge hose since they are not sufficiently surrounded by the mortar to be adequately lubricated. Thus, the formation of rock pockets in the pump discharge line has the disadvantage of significantly increasing discharge line pressure with the result that the pumping apparatus is subjected to increased strain and wear.

Another disadvantage inherent with partially open valves is that the valve parts are rapidly eroded by the mortar phase passing therethrough during the occurrence of mix separation. Such erosion increases the valve opening and as the valve opening increases, erosion and wear increase, with the result that the wear rate of the valve is not constant, but rather increases rapidly with use.

In order to avoid the problems of mix separation and increased wear rate, attempts have been made to design pump valves which close completely. Unfortunately, such prior art valves tend to crush rock during their operation and this rock crushing causes the valves to wear very rapidly. Due to the rapid wear caused by the crushing of the rock, these prior valves in a short time are generally worn to such extent as to no longer fully close. Once the valves no longer fully close, they then function the same as the partially open valves above described, and consequently have the above-mentioned drawback of having a wear rate which increases with use and also the drawback of causing mix separation.

Prior art concrete pumping systems have also generally been susceptible to the admission of air at their valve seals during pumping operations. The admission of air, in addition to reducing the volumetric efficiency of the pumping operation, also causes undesirable surge effects in the pump discharge line due to the presence of the admitted air therein. Also, prior art valves, which as abovementioned are generally subjected to considerable wear by the rough concrete mixtures they pump, have often not been designed for ready disassembly, repair and replacement of worn parts.

SUMMARY OF THE INVENTION

Accordingly, an object of the present invention is to provide improved pumping apparatus suitable for pumping unset low slump plastic concrete, such as zero slump concrete, and the like which includes an improved valve that completely closes, may be shifted from one position to another without crushing rock, and has a uniform wear rate so as to require little maintenance.

It is a further object of the present invention to provide an improved pumping apparatus suitable for pumping low water-cement, high aggregate mixes and other coarse mixes which includes a plurality of sliding sleeve-piston type pump mechanisms which operate sequentially in conjunction with a shifting sliding valve having wear plates and which prevents the crushing of rock during shifting of the slide valve by being constructed so that the ends of the pistons and sleeves when fully extended lie in the same plane as the wearing faces of the wear plates.

It is, additionally, an object of the present invention to provide an improved pumping apparatus suitable for pumping low slump concrete and the like having an improved valve positioned at an easy to get at location which includes wear plates positioned in sliding contact with each other which may readily and inexpensively be replaced.

In accomplishing these and other objects, there is provided in accordance with the present invention a mobile pumping apparatus suitable for pumping plastic low slump concrete and the like. The pumping apparatus includes a hopper with a discharge end. A plurality of channels is formed in the bottom portion of the hopper, and discharge outlets are formed in the discharge end in axial alignment with these channels. A sliding sleeve-piston pump mechanism is associated with each channel. Each pumping mechanism includes a cylindrical sleeve and piston, the piston being retracted while the sleeve is extended across the hopper into its associated discharge outlet to fill the sleeve with concrete. Thereafter, the piston is actuated for pumping plastic concrete from the sleeve through its associated discharge outlet. Each sleeve is secured at one end to a sleeve guide mounted on a sleeve carriage slidably mounted upon a pair of parallel guide rods. The sleeve-piston pump mechanisms are automatically operated alternately. A resilient lining is secured in the channels to prevent the build-up of concrete under the sleeves as they are extended in the channels. This arrangement makes it possible for the pumping mechanisms to substantially completely empty the hopper. A shiftable slide valve, including a discharge nozzle and replaceable wear plates, is mounted on the hopper to control the alternate discharge of concrete form the two discharge outlets. A hose is connected to the discharge nozzle and control means which are preferably hydraulically operated are included to progrm the operation of the sliding sleeve-piston pumping mechanisms and the shifting of the sliding valve so that the pumping apparatus operates to pump segregated portions of concrete in a relatively rapid manner through the hose connected to the discharge nozzle. Rotatable blades may be mounted in the hopper to agitate the plastics concrete therein, thereby to feed the concrete into the channels and to prevent the concrete from bridging, i.e. forming an arch in the hopper in the region over the channels so as to block the flow of concrete into the channels. The pumping apparatus is designed to prevent the crushing of rock during shifting of the slide valve by being constructed so that the ends of the pistons and sleeves when fully extended lie in the same plane as the wearing faces of the valve wear plates.

Additional objects of the present invention reside in the specific construction of the exemplary pumping apparatus hereinafter particularly described in the specification and shown in the several drawings.

Figure 1:
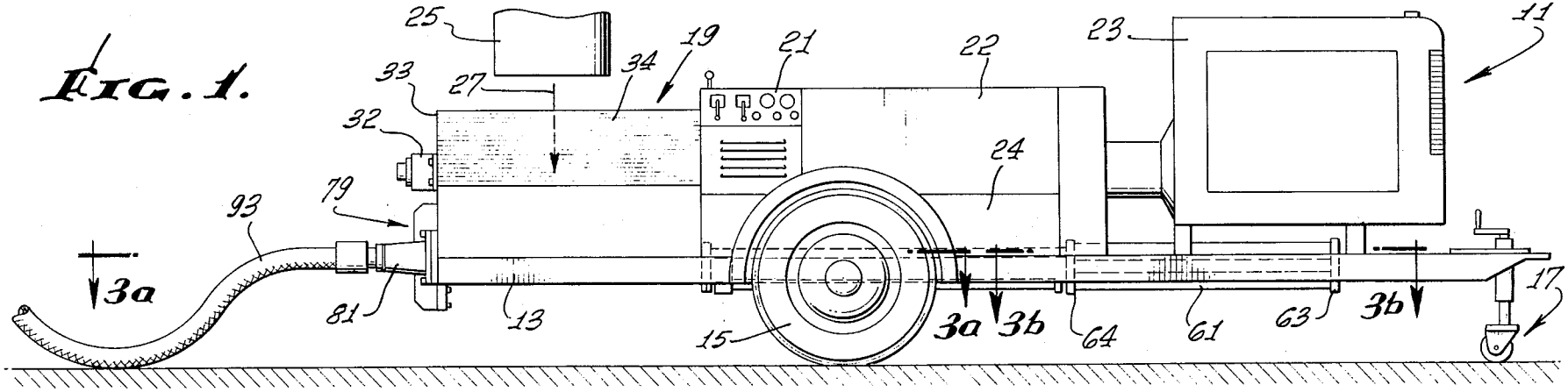
FIG. 1 is a side elevation view of a mobile concrete pumping apparatus constructed according to the present invention.
Figure 3A:
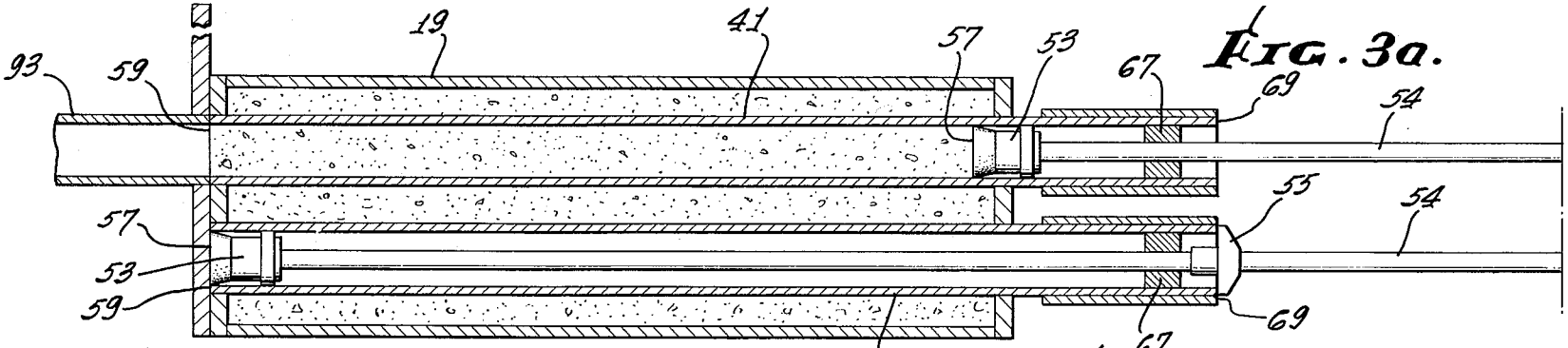
Figure 3B:
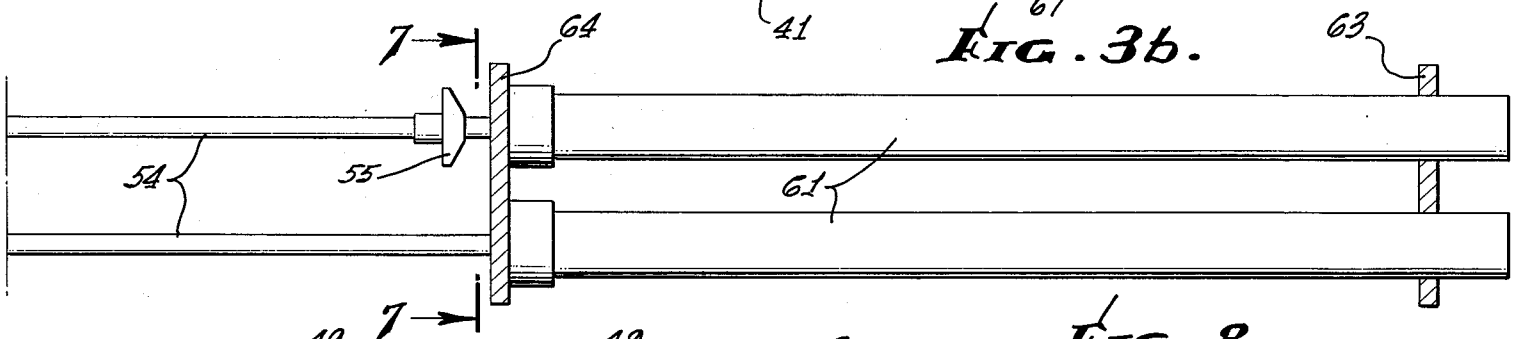
Figure 7:
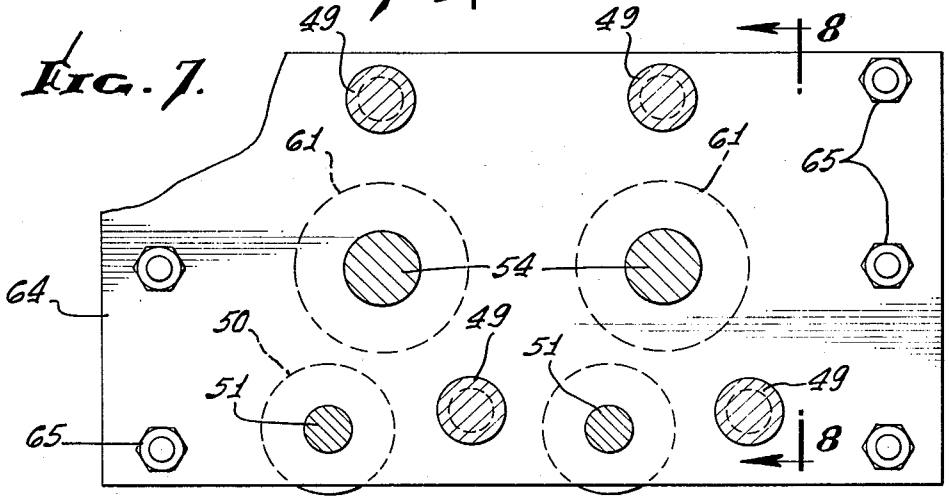
Figure 4:
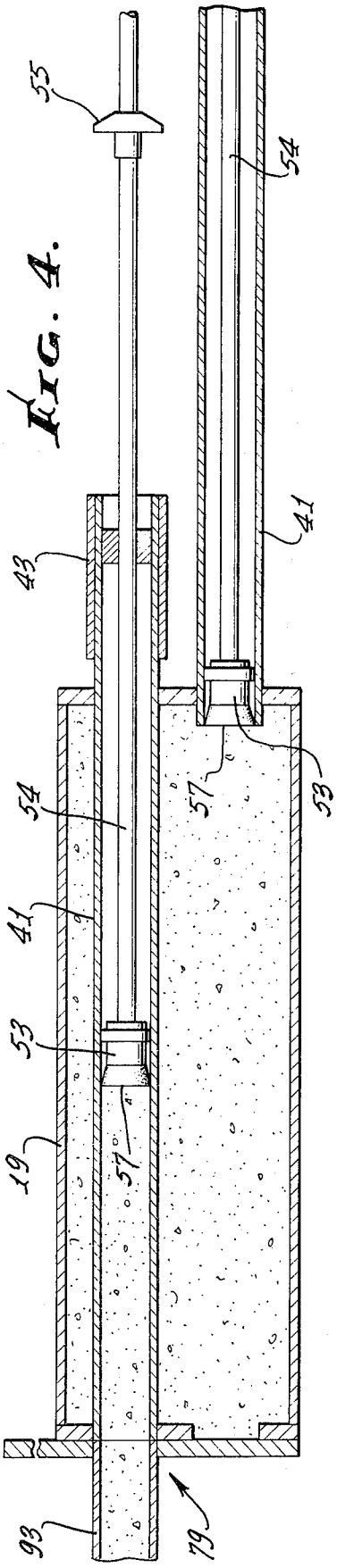
Figure 5:
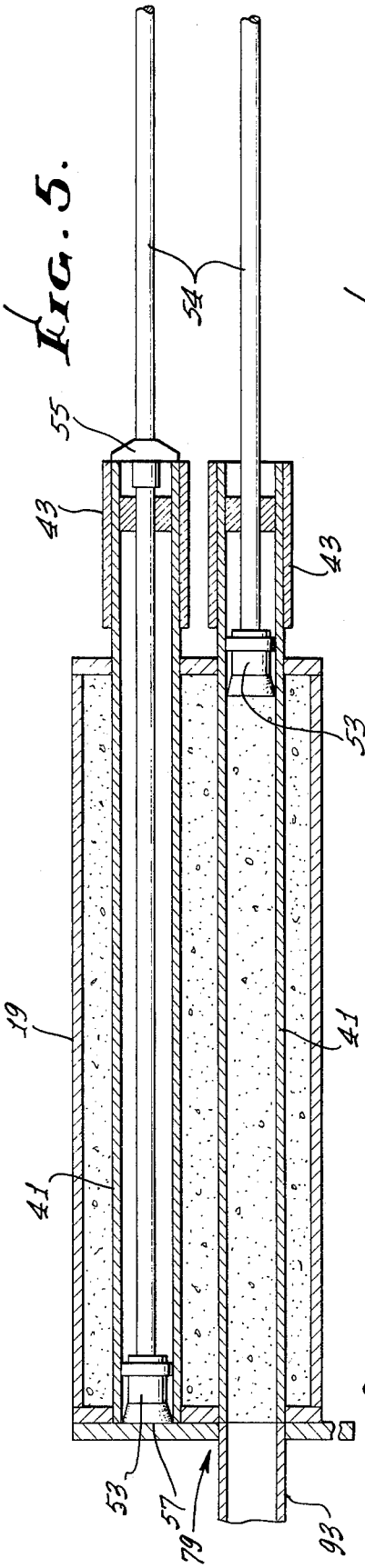
Figure 6:
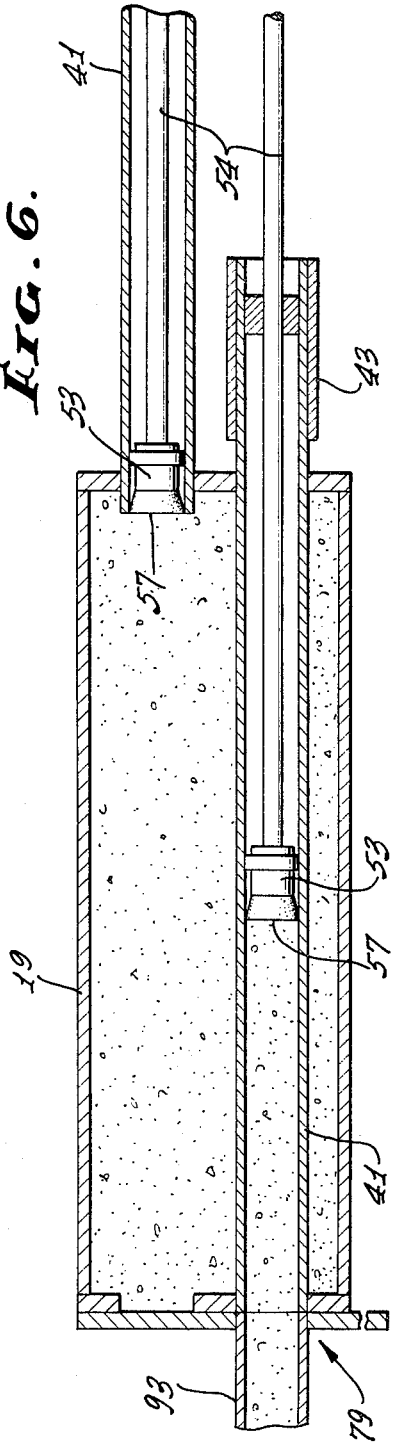

FIGS. *3a* and *3b* are fragmentary longitudinal sectional views taken along lines *3a—3a* and *3b—3b* of FIG. 1, respectively, and illustrate the sliding sleeve-piston pumping mechanisms incorporated in the pumping apparatus of FIG. 1;

FIGS. 4, 5 and 6 illustrate the sequence of operation of the slide valve assembly and the sliding sleeve-piston pump mechanisms of FIG. 3;

FIG. 7 is a transverse sectional view taken along the line 7—7 of FIG. *3b;*

Figure 8:
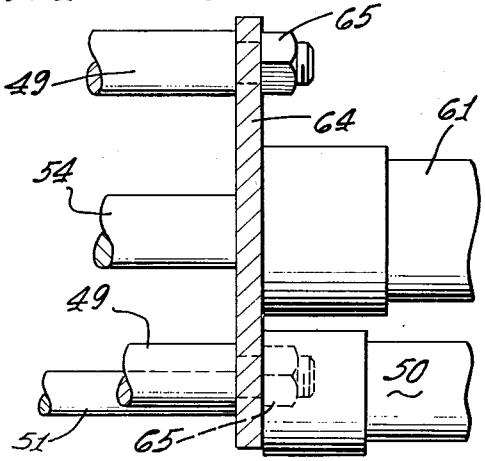
Figures 9, 10:
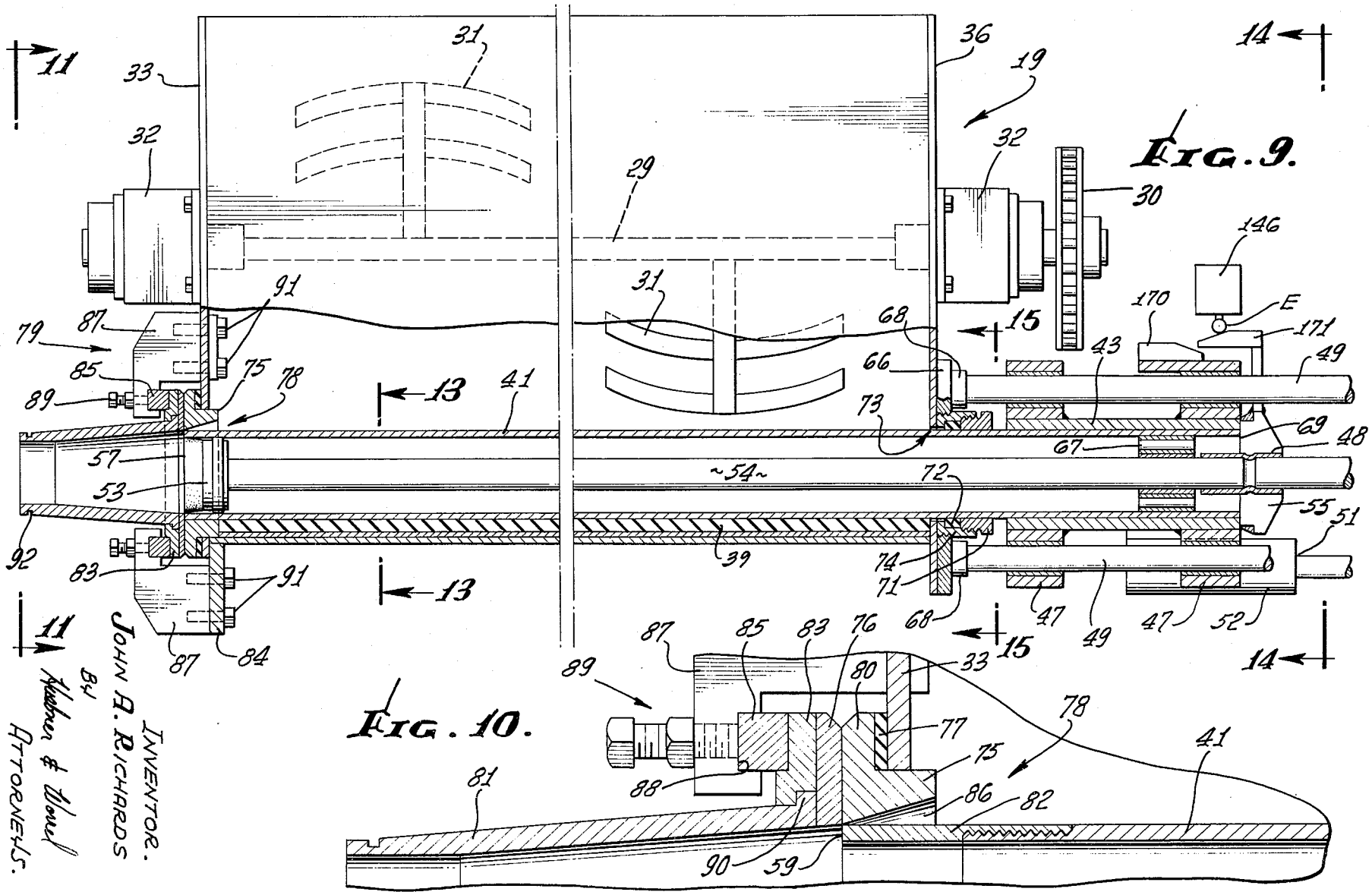
Figure 11:
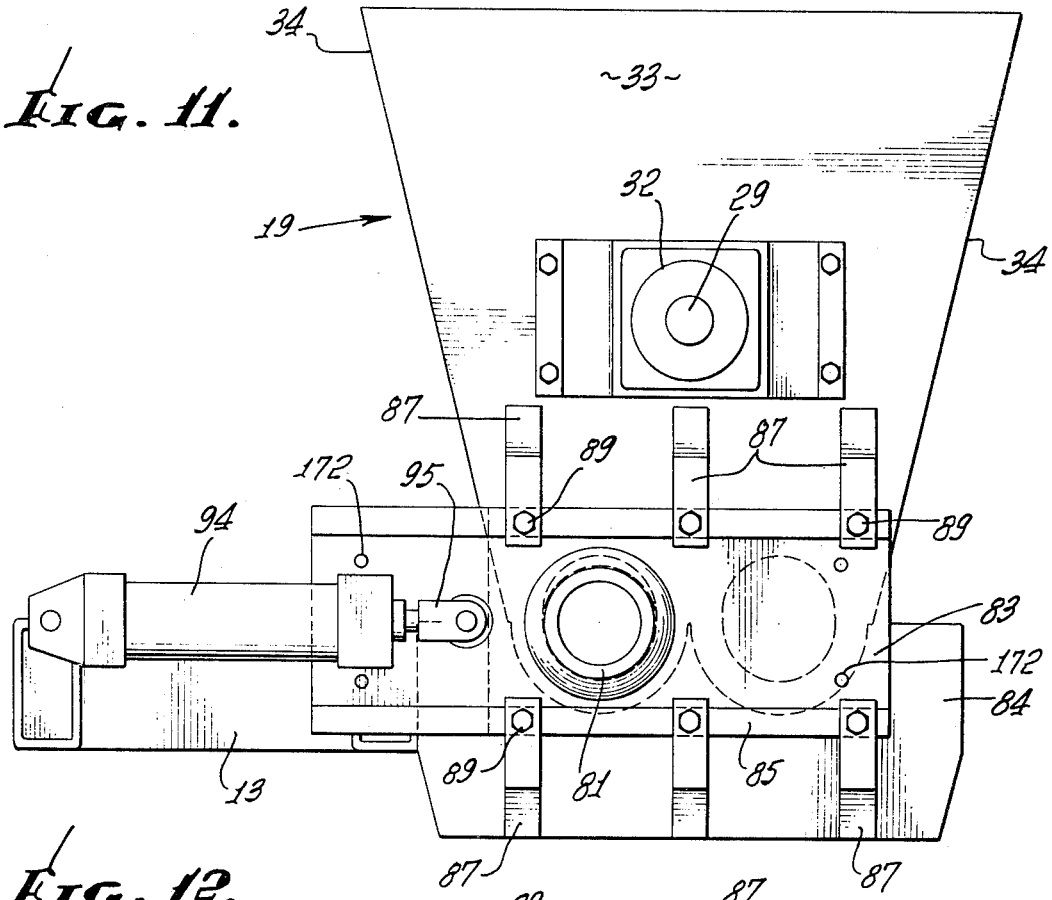
Figure 12:
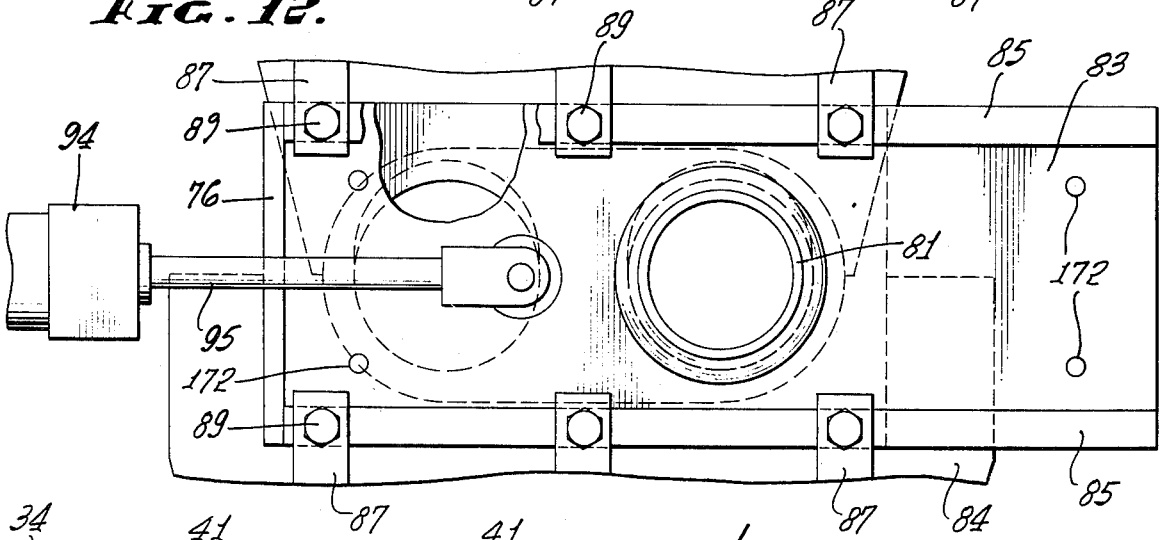
Figure 13:
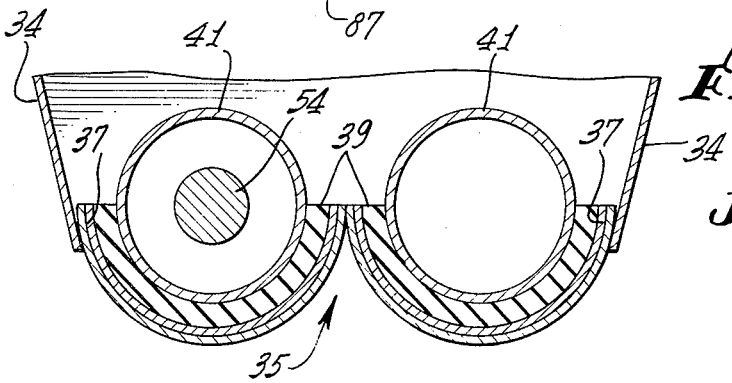
Figure 14:
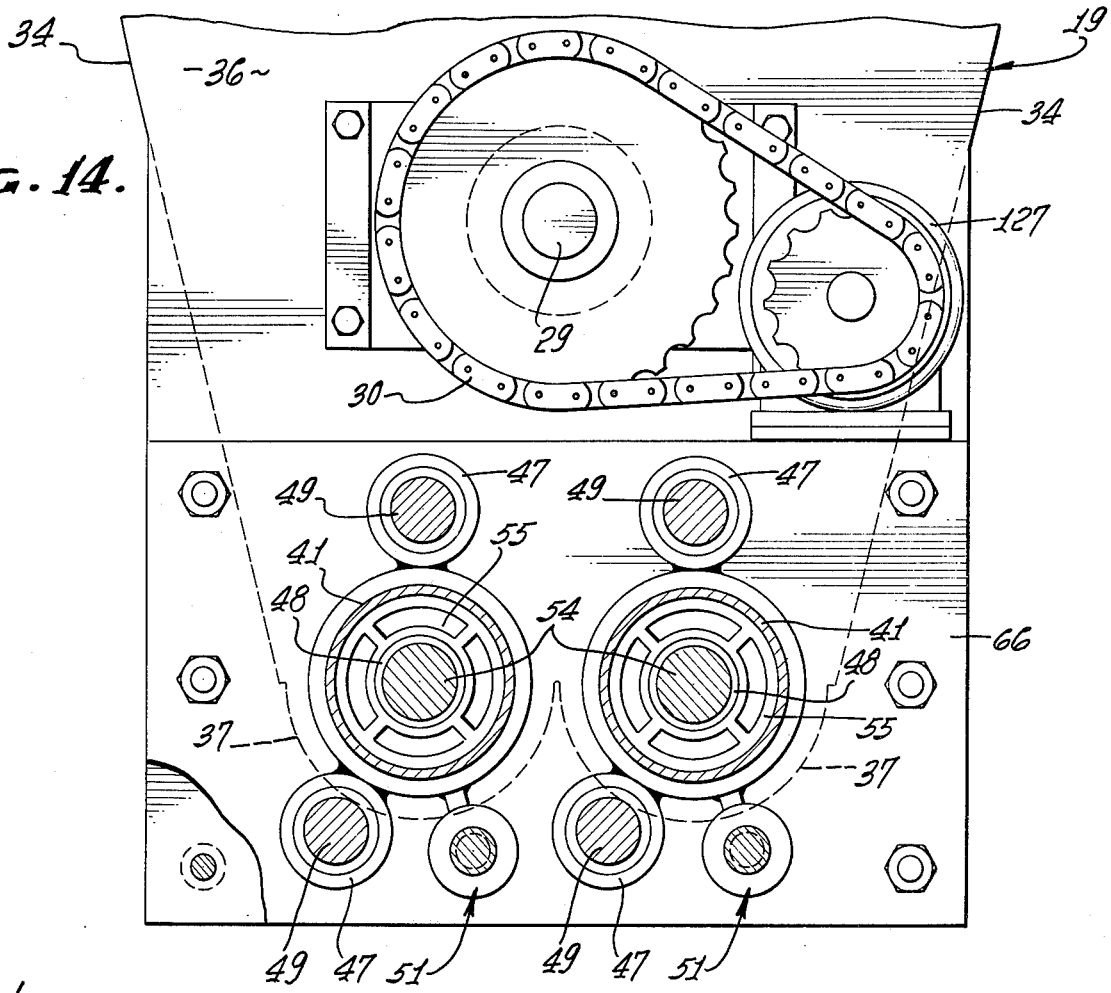

FIG. 8 is a vertical sectional view taken along the line 8—8 of FIG. 7;

FIG. 9 is a partial side elevation view with a portion of the hopper and discharge end portion of the pumping apparatus of FIG. 1 shown in cross section;

FIG. 10 is an enlarged fragmentary sectional view of the upper portion of the sliding valve assembly shown in FIG. 9;

FIG. 11 is a rear end view of the slide valve assembly viewed along the line 11—11 of FIG. 9, showing the slide valve ssembly shifted to its nonextended position;

FIG. 12 is a similar view of the slide valve assembly shown in FIG. 11 except that the slide valve assembly is shown shifted to the right to its extreme position;

FIG. 13 is a fragmentary vertical sectional view taken along the line 13—13 of FIG. 9, particularly showing the rubber-lined channels;

FIG. 14 is a fragmentary vertical sectional view taken along the line 14—14 of FIG. 9 showing the drive means for the hopper blades and the sleeve carriages.

Figure 15:
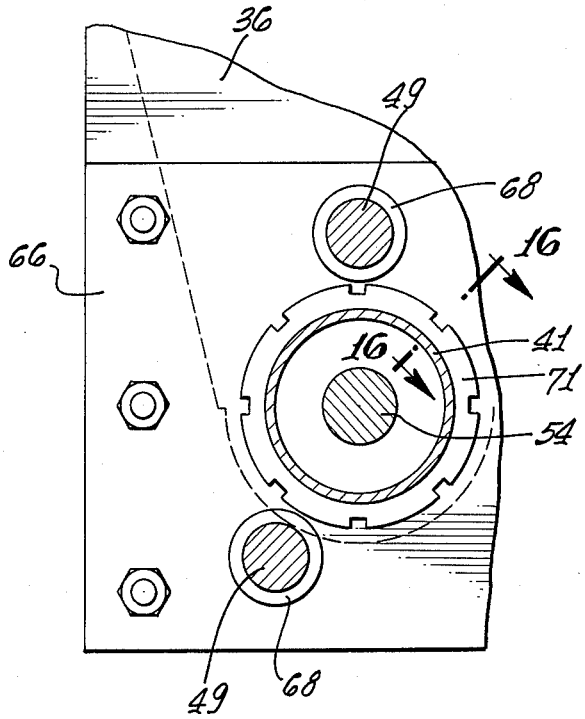
Figure 16:
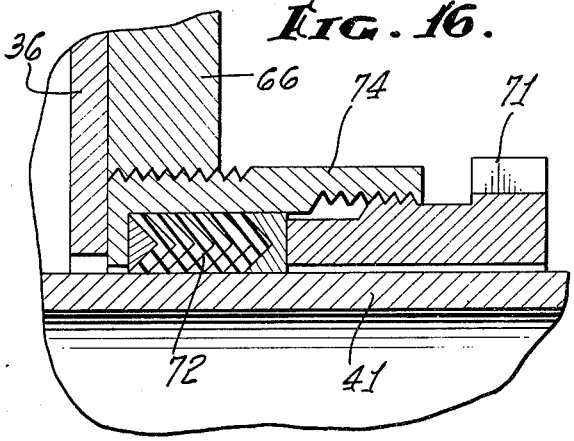
Figure 17:
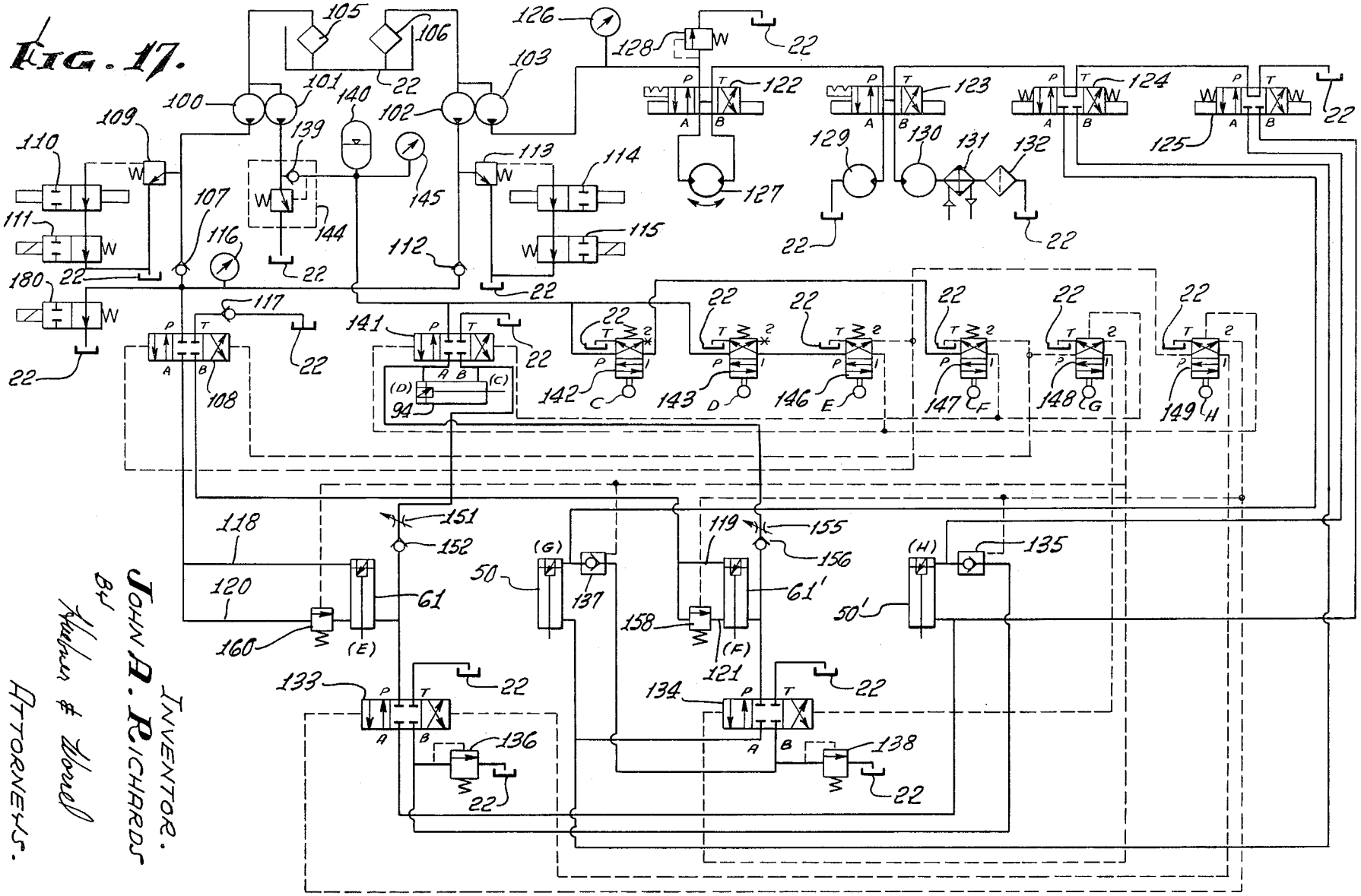

FIG. 15 is a fragmentary vertical sectional view taken along the line 15—15 of FIG. 9 showing the notched collar of the sealing means;

FIG. 16 is a fragmentary sectional view taken along the line 16—16 of FIG. 15 showing the sleeve sealing means; and FIG. 17 is a schematic diagram of a hydraulic control system that may be incorporated into the pumping apparatus of FIG. 1 to program its operation.

DETAILED DESCRIPTION OF PREFERRED EMBODIMENTS

Figure 2:
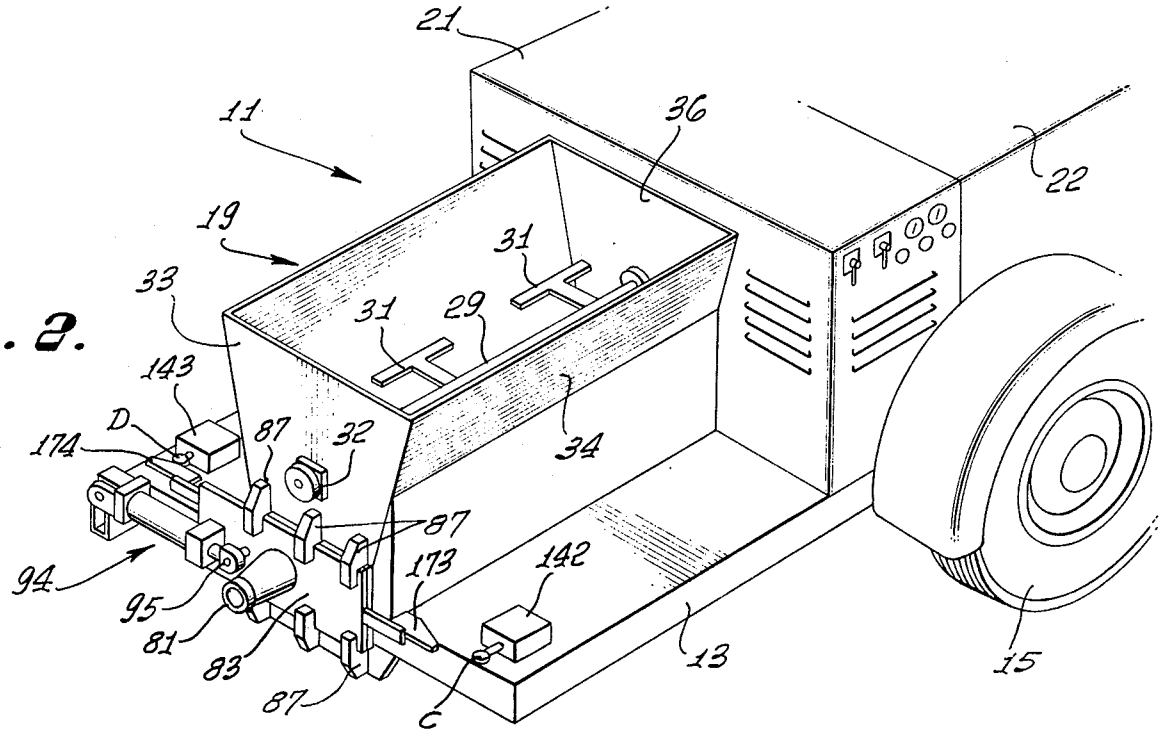
FIG. 2 is a perspective view of the rear portion of the pumping apparatus of FIG. 1 with the discharge hose removed.

Referring to the drawings in more detail, there is shown in FIGS. 1 and 2 a concrete pumping apparatus generally designated by the numeral 11. The pumping apparatus 11 is mounted on a mobile frame 13 including a rear set of wheels 15 and a front centrally located relatively smaller parking wheel 17. The wheel 17 provides an adjustable front support for the frame 13, and the frame 13 preferably includes a trailer hitch (not shown) so that it may be towed from one location to another.

Mounted on the rear portion of the frame 13 is an upwardly opening concrete hopper 19. The hopper 19 opens upwardly so that it may receive a charge of unset plastic concrete, such as low or even zero slump concrete. A conventional concrete supply chute 25 is shown in FIG. 1 positioned over the hopper 19 for supplying thereto a charge of plastic concrete arbitrarily represented by the directional arrow 27.

The concrete hopper 19 includes a rear or discharge end 33, sides 34, a bottom portion 35 and a front end 36. The ends 33 and 36 are preferably vertically extending walls and the side walls 34 are constructed to slope inwardly towards the bottom portion 35 of the hopper 19. The hopper bottom portion 35 is shown in more detail in FIG. 13 and has a pair of longitudinally extending channels 37 formed therein which open upwardly. The channels 37 have preferably semicylindrical shapes and have their longitudinal axes mutually parallel. Resilient linings 39, which are preferably made of rubber, are positioned and secured in the channels 37. The linings 39 are shaped to confirm to the shape of the channels 37.

Mounted also on the apparatus frame 13 is a control panel 21 shown positioned just forward of the hopper 19. The control panel 21 includes the control levers, electrical switches, pressure gauges and temperature gauges necessary for controlling the operation of the pumping apparatus 11. Mounted on the frame 13 immediately forward of the control panel 21 is a pair of hydraulic fluid reservoirs 22 and a pair of water tanks 24. One reservoir 22 and tank 24 is mounted on each side of the frame 13 with the hydraulic reservoir 22 being positioned over the water tank 24 as shown in FIG. 1. A power supply or plant 23 is mounted on the frame 13 forward of the reservoirs 22. The power plant 23 is preferably a conventional type of internal combustion engine and includes a battery and d.c. generating system.

Mounted to extend longitudinally through the hopper 19 is a shaft 29 which is preferably horizontally disposed. The shaft 29 has blades 31 secured thereon. The blades 31 are preferably similar to the type of blades used in a conventional plaster mixer. The shaft 29 is rotatably mounted in bearings 32 secured to the hopper end walls 33 and 36 and is driven through a chain drive mechanism 30 which is shown in FIGS. 9 and 14. The chain drive mechanism 30 is driven by a conventional power source 127, shown in FIGS. 14 and 17. The power source 127 is preferably a reversible hydraulically powered motor. The shaft 29 may be driven in either direction by the motor 127 to rotate the blades 31 in the hopper 19 to force the plastic concrete charge in the hopper downwardly into the rubber-lined channels 37 of the hopper bottom portion 35. By driving the concrete charge downwardly, even zero slump concrete, which is characterized by being relatively dry and stiff, is forced into the rubber liners 39 in the hopper channels 37 and concrete is prevented from bridging between the sloping hopper side walls 34 over the channels 37. The bridging of concrete over the channels 37 would have the adverse effect of blocking concrete flow into the lined hopper channels 37 and consequently must be prevented.

First and second concrete confining sleeves 41 are included in the pumping apparatus 11. The sleeves 41 are preferably cylindrical in shape and are dimensioned to have an outer diameter which is equal to or slightly greater than the inner diameter the resilient channel linings 39. Openings 73, one of which is identified in FIG. 9, are formed in the hopper end wall 36 in line with the longitudinal axes of the hopper channels 37. The sleeves 41 are mounted within the openings 73 so that each sleeve 41 may be extended into or retracted from one of the hopper channels 37 by being slid along the resilient channel linings 39. As a result, the resilient linings 39 are slightly compressed by the sliding movement of the sleeves 41 and the linings 39 wipe against the bottom halves of the sleeves 41, thereby to prevent the accumulation of concrete between the sleeves 41 and their linings 39 as the sleeves 41 are reciprocally moved into and out of the hopper bottom portion 35.

The length of the sleeves 41 is dimensioned to be slightly longer than the longitudinal dimension of the hopper channels 37. Each sleeve 41 has opposite ends which are identified by the numerals 59 and 69. The sleeve ends 59 are the ends which are extended into and withdrawn from the hopper channels 37 while the sleeves ends 69 are always located externally of the hopper 19. Each sleeve 41 is secured at its end 69 in a sleeve guide 43, as shown in FIG. 9. The sleeve guides 43 are each mounted in a sleeve carriage 47 and each carriage 47 is slidably mounted on a pair of mutually parallel guide rods 49.

Connected to each sleeve carriage 47 is one end of a sleeve push rod 51. The rods 51 are connected to the carriage 47 by means of connecting blocks 52. The other end of each push rod 51 is connected with the rod of a hydraulic cylinder mechanism 50. The two cylinder mechanisms 50, which are hereinafter referred to in connection with the hydraulic control circuit shown in FIG. 17 as sleeve cylinders 50 and 50', may be actuated to extend the sleeves 41 into the hopper channels 37 by pumping hydraulic fluid into the blind ends of the cylinders 50 and may be actuated to withdraw the sleeves 41 from the channel 37 by pumping hydraulic fluid into the rod ends of the cylinders 50. It is noted that while pumping hydraulic fluid into one end of one of the cylinders 50 that hydraulic fluid is permitted to exit from its other end.

Each sleeve carriage 47 carries a cam 170 one of which is representatively shown in FIG. 9. The cams 170 function to cam or depress the rollers G and H on cam valves 148 and 149. The cam valves 148 and 149 are shown in FIG. 17. The cam valves 148 and 149 are each two position spool valves with a hydraulic return, and each functions to reverse the direction of movement of the sleeve 41 with which it is associated. The rollers G and H of the cam valves 148 and 149 are positioned on the apparatus frame 13 so that they are shifted by their cams 170 whenever their respective sleeve 41 is fully retracted. As is hereinafter explained in greater detail, each of the cam valves 148 and 149 functions when shifted by its cam 170 to divert hydraulic fluid being supplied to the rod end of a sleeve cylinder 50 to its blind end so that once a sleeve 41 is fully retracted by its sleeve cylinder 50 it will automatically be re-extended. It is noted that since the two position cam valves 148 and 149 are cammed to one position and hydraulically shifted or returned by pilot signals to their other position that they function as if detented, that is to say, the cam values 148 and 149 hold in the position to which they had been shifted.

Concrete pumping pistons 53 are slidably fitted within each concrete confining sleeve 41. The pistons 53 are preferably made of urethane cups, felt wipers and steel back-up rings with the urethane cups forming the flat piston ends 57. Each piston 53 is mounted on one end of a pushrod 54 and the other ends of the push rods 54 are connected by connectors 48 to the rods of hydraulic cylinder mechanisms 61. The two cylinder mechanisms 61, which are hereinafter referred to as piston cylinders 61 and 61' in connection with the hydraulic control circuit shown in FIG. 17, may be actuated to extend the pistons 53 into their respective sleeves 41 by pumping hydraulic fluid into the blind ends of the cylinders 61 while permitting hydraulic fluid to exit from their rod ends.

Mechanical stops 55 are mounted on each piston rod 54 around each rod connector 48. The stops 55 limit the extension of the pistons 53 into their respective sleeves 41 by contacting the sleeve ends 69 whenever the pistons 53 have been extended to what may be called their fully extended position. A piston 53 when in its so called fully extended position is positioned as shown in FIG. 9 with its flat piston face 57 aligned in the same plane as the end 59 of its sleeve 41. The mechanical stops 55 also function as abutments to retract the pistons 53 whenever their respective sleeves 41 are retracted since the sleeve end 69 of a sleeve 41 being retracted forces the mechanical stop 55 in the direction of sleeve retraction. Thereby, an extended piston 53 is automatically moved to its retracted position by the retraction of its sleeve 41. During the retraction of a piston 53, it is noted that hydraulic fluid is permitted to flow from the blind end of its piston cylinder 61. It is also noted that bearings 67 for the push rods 54 are mounted in the sleeves 41 adjacent their ends 69. The push rods 54 extend through the bearings 67.

Each mechanical stop 55 carries a cam 171 one of which is representatively shown in FIG. 9 so that the movement of the cams 171 corresponds to the movement of the pistons 53. The cams 171 function to cam the rollers E and F on cam valves 146 and 147. The cam valves 146 and 147 are both shown in FIG. 17 while only the cam valve 146 is representatively shown in FIG. 9. The cam valves 146–147 are each two position spool valves with a spring return. The cam valves 146 and 147 generate hydraulic pilot signals to control the flow of hydraulic fluid to a cylinder mechanism 94 which shifts a slide valve assembly 79. The function of the slide valve assembly 79 is hereinafter discussed. The rollers E and F of the cam valves 146 and 147 are positioned on the apparatus frame 13 so that they are shifted by their cams 171 whenever their respective pistons 53 are fully extended. FIG. 9 shows the roller E being cammed upward to shift the cam valve 146.

Referring to FIG. 3*b*, the piston cylinders 61 are there shown supported by support members 63 and 64. The support members 63 and 64 support, respectively, the blind and the rod ends of the cylinders 61. Further, as shown in FIG. 8, the guide rods 49 for the sleeve carriages 47 are bolted at 65 to the support member 64. As shown in FIG. 1, the support members 63 and 64 are secured on the forward half of the frame 11.

Sealing arrangements are mounted exteriorly of the hopper 19 on the hopper end 36 around each of the openings 73. These sealing arrangements are provided to prevent the leakage of concrete through the openings 73 as the concrete confining sleeves 41 are reciprocally moved therethrough. One of the sealing arrangements is shown in FIGS. 9 and 14 and includes a mounting plate 66, threaded interfitting collars 71 and 74, and sealing material 72. The mounting plate 66 is secured on the hopper end 36 and has threaded openings therein which are larger than and aligned with the hopper openings 73. The collars 74 are screwed into these openings in the plate 6, and a suitable sealing and bearing material is placed or packed between the collars 74 and the sleeves 41. The interfitting collars 71 are screwed into the outer collars 74 to hold the sealing material 72 in place. The collars 71 are peripherally notched as shown in FIG. 15 to enable turning thereof by a spanner wrench. It is also noted that seats 68 are formed on the plate 66, as shown in FIG. 9. Each seat 68 is designed to receive and support one end of one of the carriage guide rods 49.

The hopper discharge end 33 has outlet defining structure or means 78 secured externally thereon to extend into a pair of openings formed in the hopper end 33, these openings being formed in axial alignment with the hopper channels 37. The outlet defining structure 78 shown in detail in FIGS. 9 and 10, is preferably made of one piece, and includes a wear plate 80 with two collars 75 extending therefrom. The wear plate 80 is secured on the outer side of the hopper end 33 with the collars 75 extending into the pair of openings formed therein. A flat gasket 77 is positioned between the wear plate 80 and the hopper wall 33 to provide a concrete seal.

Each collar 75 provides a discharge outlet 86 through the structure 78. The outlets 86 are formed to receive and guide the ends 59 of the concrete confining sleeves 41. The sleeve ends 59 are preferably formed by cylindrical wear rings 82 which are threaded and thus adjustably secured on the sleeves 41. The wear rings 82 are removable and may be replaced when worn. The lower half of each outlet 86 is semi-cylindrically shaped like the hopper channels 37 while the upper half of each outlet 86 is enlarged at its inner end and narrows towards the wear plate 80, preferably being formed like the portion of a cone. It is noted that in order to prevent the crushing of rock between the sleeve ends 59 and a movable slide valve wear plate 76, which alternately opens and closes the outlets 86, the length of the stroke of the rods of the piston cylinders 61 is preferably made slightly longer than the length of the stroke of the rods of the sleeve cylinders 50. Thereby, excess concrete confined in an extending sleeve 41 due to the volume of concrete in an outlet 86 which must be displaced or moved out of the way of the sleeve end 59 can force the retracted piston 53 within the sleeve, a slight distance inwardly toward the sleeve end 69 to provide additional room in the sleeve for this excess concrete.

It is noted that with one of the sleeves 41 and its concrete piston 53 positioned in their fully extended position, as shown in FIG. 9, the planar wear face of the fixed wear plate 80, the sleeve end 59 and the piston end 57 are all aligned in the same plane which in the exemplary apparatus 11 herein described is a vertical plane. It is additionally noted that adjusting means may be provided for increasing the effective length of the sleeve carriage push rod 51 to compensate for wear on the removable sleeve ends 82. An adjustment would also be then provided for appropriately setting the mechanical stops 55 on the piston push rods 54 so that the pistons ends 57 would still align when fully extended with the sleeve ends 59 and the wear face of the wear plate 80.

The slide valve assembly or mechanism 79 is mounted on the hopper discharge end 33. The slide valve 79 controls the opening and closing of the discharge outlets 86 and includes the wear plate 76. The wear plate 76 has a planar wear side positioned in sliding contact with the wear side of the wear plate 80. The plate 76 has a single opening formed therein, which may be aligned with either of the discharge outlets 86 by sliding the wear plate 76 laterally across the wear plate 80. Thereby, the movable wear plate 76 may be selectively positioned to open one of the discharge outlets 86 while closing the other and vice versa.

Mounted on the outer side of the movable wear plate 76 around the opening therein is a discharge nozzle 81, FIGS. 9 and 10. The nozzle 81 has an annular flange 90 thereon over which a mounting plate 83 is fitted. The nozzle 81 narrows towards its discharge end, has a circumferential groove 92 formed in the outer periphery of its discharge end, and is designed so that a conduit or flexible hose 93 may be connected thereto as shown in FIG. 1. Dowels 172, FIG. 11 or other suitable means are used to secure the mounting plate 83 to the wear plate 76, thereby to secure the nozzle 81 in place.

Mounting structure 87, FIG. 9 which includes a plurality of elbow shaped members is secured by bolts 91 on both the hopper end 33 and on a fixed mounting plate 84. The plate 84 extends downwardly from the bottom of the hopper discharge end 33. The elbow shaped members 87 each extend to positions adjacent but spaced apart from the mounting plate 83, and upper and lower laterally extending grooves 88 are provided in the members 87. Bolts 89 are threaded into holes formed in each of the elbow shaped members 87 so that the bolts 89 may be extended into the grooves 88 by turning them. Bearing members or means 85, which are preferably brass bars having rectangular cross-sections, are fitted in the grooves 88. The bearing members 85 are thus positioned between the elbow shaped members 87 and the mounting plate 83 so that by tightening the bolts 89 the bearing members 85 may be adjusted to uniformly press the mounting plate 83 against the sliding valve plate 76.

The bearing members 85, therefore, in addition to providing low friction bearing surfaces across which the mounting plate 83 may be laterally moved, also provide the means for applying uniform pressure to the mounting plate 83 and the movable wear plate 76. Consequently, by adjusting the bolts 89, the pressure at which the movable wear plate 76 is held against the fixed wear plate 80 may be controlled so that a concrete sealing relationship may be maintained between the wear surfaces of the pair of wear plates. Further, wear caused by the sliding movement of the wear plates 76 and 80 against each other may be compensated for by tightening the bolts 89.

The slide valve 79, FIGS. 2, 11 and 12, is shifted between a retracted position and an extended position by means of a hydraulic cylinder mechanism 94, which is hereinafter referred to as the valve cylinder 94. The valve cylinder 94 is secured at its blind end to the frame 13 and its rod 95 is connected to the outer surface of the valve mounting plate 83. By pumping hydraulic fluid to the rod end of the cylinder 94, while permitting hydraulic fluid to flow from its blind end, the cylinder rod 95 may be fully retracted into the cylinder 94, thereby to shift the slide valve 79 to its so called retracted position. The slide valve 79 is shown in its retracted position in FIGS. 2 and 11. In the slide valve's retracted position, the opening in the movable wear plate 76 and the discharge nozzle 81 are aligned and in communication with the discharge opening 86 and the hopper channel 37 nearest to the valve cylinder 94. Conversely, by pumping hydraulic fluid to the blind end of the cylinder 94 while permitting hydraulic fluid to flow from its rod end, the cylinder rod 95 may be fully extended from the cylinder 94, thereby to shift the slide valve 79 to its so called extended position shown in FIG. 12. The opening in the movable wear plate 76 and the discharge nozzle 81 are aligned and in communication with the other discharge opening 86 and the hopper channel 37 remote from the valve cylinder 94 when the slide valve 79 is in its extended position.

Referring to FIG. 2, cams 173 and 174 are representatively shown mounted on the slide valve mounting plate 83 to extend laterally to each side of the slide valve 79. Cam valves 142 and 143, which form part of the hydraulic control circuit shown in FIG. 17, are representatively shown mounted on the frame 13. The cam valves 142 and 143 are two position spool valves having spring returns and include, respectively, rollers C and D which may be cammed or actuated to shift the cam valves 142 and 143. The cam valve 142 is positioned on the frame 13 so that its roller C is cammed by the cam 173 whenever the slide valve 79 has been shifted to its extended position. The shifting of the cam valve 142 by the cam 173 operates as hereinafter explained to cause the extension of the piston 53 remote from the valve cylinder 94. The cam valve 143 is positioned on the frame 13 so that its roller D is cammed by the cam 174 whenever the slide valve 79 has been shifted to its retracted position. The shifting of the cam valve 143 by camming its roller D causes the extension of the piston 53 nearest to the valve cylinder 94.

Before discussing the programmed operation of the exemplary concrete pumping apparatus, it is well to here note several characteristics of the operation of the slide valve 79 in the apparatus 11. First, tbe slide valve 79 is located externally at the hopper end 33 so as to be positioned in an easy to get at location. Secondly, the slide valve 79 controls the pumping of concrete by use of a pair of wear plates 76 and 80, which are inexpensive and easily replaceable. Thirdly, the slide valve 79 wears uniformly across the wear surfaces of the wear plates so that even as the plates 76 and 80 wear there is never a dimensional change between the contacting wear surface. Thus, the wear rate of the valve 79 at all times remains uniform. Further, since the wear plates 76 and 80 are pressed or loaded one against the other and means are provided for compensating for the wear, and thus thinning, of the wear plates, an effective valve seal may be maintained to prevent the drawing of air into the pump's discharge line or hose 93. Additionally, the slide valve 79 may be shifted between its extended and retracted positions by shifting the movable wear plate 76, without the danger of crushing rock, since the wear surfaces of the wear plates 76 and 80, the piston ends 57 when their pistons 53 are fully extended, and the sleeve ends 59 when their sleeves 41 are fully extended, all lie in the same plane.

An exemplary hydraulic control system or means is shown in FIG. 17 for controlling the operation of the concrete pumping apparatus 11 and programming the movement of the slide valve assembly 79, the confining sleeves 41 and the pistons 53. In FIG. 17, the sleeve cylinders are designated 50 and 50', the piston cylinders are designated 61 and 61', and the hydraulic fluid reservoirs and the fluid returns thereto are all identified by the numeral 22. Oil is preferably used as the hydraulic fluid in the system and the hydraulic supply lines are shown in solid lines while the hydraulic pilot lines are shown in dashed lines.

The hydraulic system includes, in addition to the hydraulic cylinders 50, 51', 61 and 61', the valve cylinder 94 and a pilot system which includes the aforementioned cam valves 142–143 and 146–149. Each of these cam valves 142–143 and 146–149 are two position four way spool valves and have their pressure ports labeled P and T for pressure and tank, respectively, and their cylinder or outlet ports labeled 1 and 2. The cam valves 142–143 and 146–149 each have a cross-over and a straight position as indicated. The cam valves 142–143 and 146–147 are normally held in their cross-over position by springs and are cammed to their straight positions. The cam valves 148 and 149 are cammed to their straight position and have a hydraulic return so that they may be piloted to their cross-over positions.

As before discussed, the roller C is cammed to shift the cam valve 142 when the cylinder rod of the valve cylinder 94 is fully extended while the roller D is cammed to shift the cam valve 143 when the valve cylinder rod is fully retracted. To indicate this, the symbols (D) and (C) have been placed at the blind and rod ends of the valve cylinder 94. Likewise, the symbols (E) and (F) are placed at the rod ends of piston cylinders 61 and 61', respectively, to indicate that the rollers E and F are cammed to shift cam valves 146 and 147 whenever the rods of these piston cylinders are fully extended. Further, the symbols (G) and (H) are placed at the blind ends of the cylinders 50 and 50' to indicate that the rollers G and H are cammed, respectively, to shift cam valves 148 and 149 whenever the rods of these sleeve cylinders are fully retracted.

The hydraulic system of FIG. 17 also includes spool valves 108, 133, 134 and 141. Each of these spool valves are three position four way valves having a straight, center and cross-over position as indicated. The pressure ports of these spool valves are identified in a conventional manner by the letters P and T indicating pressure and tank, respectively, and their cylinder ports are identified by the letters A and B. Each of the spool valves 108, 133, 134 and 141 has its center position blocked and may be hydraulically piloted to either their cross-over or straight position.

The spool valve 108 primarily functions to control the supply of hydraulic fluid to the blind ends of the piston cylinders 61 and 61'. The spool valve 108 channels fluid to the blind end of the cylinder 61 in its straight position and to the blind end of the cylinder 61' in its cross-over position. The spool valves 133 and 134 primarily control the flow of hydraulic fluid from the rod ends of piston cylinders 61 and 61', respectively, to the sleeve cylinders 50' and 50. The spool valve 133 in its straight position channels hydraulic fluid to the rod end of the sleeve cylinder 50' while permitting hydraulic fluid to flow from its blind end to tank, i.e., back to reservoir 22. In its cross-over position the spool valve 133 channels hydraulic fluid to the blind end of the sleeve cylinder 50' while permitting hydraulic fluid to flow from its rod end to tank. The spool valve 134 operates similarly to the spool valve 133 to control the flow of hydraulic fluid between the rod end of piston cylinder 61' and sleeve cylinder 50.

The spool valve 141 primarily operates to control the flow of hydraulic fluid to the valve cylinder 94 and secondarily to control the supply of make up oil to the master-slave hydraulic circuits formed between the piston and sleeve cylinders. In its straight position, the spool valve 141 supplies hydraulic fluid to the blind end of the valve cylinder 94 so that its cylinder rod is extended and hydraulic fluid from the rod end of cylinder 94 is channeled to tank. The spool valve 141 also supplies in its straight position make up hydraulic oil through variable restriction 155 and check valve 156 to the pressure port P of the spool valve 134. The rate at which the make up hydraulic fluid is supplied is controlled by appropriately setting the restriction size 155 and the make up oil is needed to compensate for the hydraulic fluid dumped to tank 22 at the time the spool valve 134 is shifted from its straight to its cross-over position. The spool valve 141 in its cross-over position retracts the cylinder rod 95 of the valve cylinder 94 and supplies make up hydraulic fluid through a variable restriction 151 and a check valve 152 to the pressure port P of the spool valve 133.

It is noted that spool valves 160 and 158, which are normally held closed by springs, are placed in the hydraulic path between the blind and rod ends of the piston cylinders 61 and 61', respectively. These spool valves 160 and 158 may be hydraulically piloted open and when shifted to their open positions operate to permit, during retraction of the piston cylinders, the flow of hydraulic fluid from the blind ends of the cylinders 61 and 61' to their rod ends. Since the blind end of a hydraulic cylinder contains more hydraulic fluid than its rod end due to the space taken up by the cylinder rod, the blind ends of the piston cylinders 61 and 61' are also connected in communication with the ports A and B, respectively, of the spool valve 108. Thereby, the additional oil in the blind ends of the piston cylinders may be dumped to tank. A restriction in the form of a check valve 117 is placed in the hydraulic path between the tank port T of the valve 108 and the reservoir 22 so that the hydraulic fluid from the blind ends of the cylinders 61 and 61' fills their cylinder rod ends before being dumped to tank.

It is also noted that check valves 137 and 135, which may be hydraulically piloted open, are connected in the hydraulic paths between the blind ends of the sleeve cylinders 50 and 50', respectively, and the B ports of the spool valves 134 and 133. These check valves operate to prevent the retraction of their cylinder rods whenever they are closed. Thereby, a sleeve cylinder rod and its respective concrete confining sleeve 41 is held in a fully extended position until their respective check valves 137 and 135 are piloted open.

To supply hydraulic fluid under pressure to the portion of the hydraulic system above-described, pumps 100, 101, and 102 are provided. The pumps 100 and 101 draw hydraulic fluid from the reservoir 22 through a strainer 105 while the pump 102 draws hydraulic fluid through a strainer 106. The pumps 100 and 102 are each for pumping hydraulic fluid to the pressure port P of the spool valve 108.

The operation of the pump 100 is controlled by a relief valve 109 and the spool valves 110 and 111. The valve 109 is a vented balanced spool relief valve which when vented to tank is blocked by a spring in an open position so that the hydraulic fluid pumped by the pump 100 is dumped to the reservoir 22. The venting of the valve 109 may be controlled by either of the valves 110 and 111. The valves 110 and 111 each are two position valves having an open and a closed position and when opened vent the relief valve 109 to the reservoir 22 so that the relief valve dumps the hydraulic fluid pumped by the pump 100 to tank. By closing either of the valves 110 or 111, the valve 109 is no longer vented, and thus since it is no longer balanced, shifts to its closed position. With the relief valve 109 closed, the pump 100 then pumps hydraulic fluid through a check valve 107 to the pressure port P of the spool valve 108.

It is noted that the spool valve 111 is normally held open by a spring and is a solenoid valve which is shifted to its closed position by energizing its solenoid. The solenoid valve 111 is normally used in controlling the operation of the pump 100. In the event that the solenoid valve 111 becomes stuck in its open position, the manual valve 110 is provided. The valve 110 may be manually shifted between its open and closed positions.

As beforementioned, the pump 102 is also provided for pumping hydraulic fluid to the pressure port P of the spool valve 108. The operation of the pump 102 is controlled by a relief valve 113 and the spool valves 114 and 115. The valves 113, 114 and 115 correspond in structure and function with the aforedescribed valves 109, 110 and 111, respectively, in controlling the operation of the pump 102. With the relief valve 113 closed, the pump 102 pumps hydraulic fluid through a check valve 112 to the pressure port P of the spool valve 108. A pressure gauge 116 is included to monitor the hydraulic pressure at the pressure port P of the spool valve 108.

The pump 101 operates to pump pressurized hydraulic fluid through a check valve 139 to the pressure ports P of the spool valve 141, the cam valve 142 and the cam valve 143. The pressure of the hydraulic fluid supplied by the pump 101 is monitored by a pressure gauge 145. An accumulator 140 and an internally piloted unloading valve 144 are included in the hydraulic system for, respectively, storing hydraulic pressure built up by the pump 101 up to a predetermined pressure level and then relieving any excess pressure over this predetermined level by bleeding hydraulic fluid from the pressure side of the pump 101 to tank. The accumulator 140 may be a tank divided by a bladder having a predetermined volume of a gas, such as nitrogen, stored in the tank on one side of the bladder and having the other side of the tank in communication with the pressurized hydraulic fluid being delivered by the pump 101. The accumulator 140 stores hydraulic fluid so that additional pressurized fluid is available at those instants when the hydraulic system demands more pressurized hydraulic fluid than is being pumped by the pump 101. Thereby, the accumulator 140 prevents any significant drops of the hydraulic pressure at the pressure ports P of the valves 141, 142 and 143.

The hydraulic control system of FIG. 17 operates to program the movement of the slide valve assembly 79, the concrete confining sleeves 41 and the pistons 53 in the following manner. It is assumed at the moment of commencing operation that the valves 110, 111, 114 and 115 are shifted to their open positions to vent the relief valves 109 and 113, and the spool valve 141 is in its cross-over position. Before commencing operation of the concrete pump 11, its motor 23 is first energized by operating a switch at the control panel 21. Thereby, the pumps 100–102 are driven. It is noted that a pump 103 is also driven but the function of this pump is described at a later point.

Even though the pumps 100 and 102 are pumping hydraulic fluid, no fluid is yet delivered to the spool valve 108 since the relief valves 109 and 113 are at this instant open and dumping this pumped hydraulic fluid to tank. The pump 101, however, is supplying pressurized hydraulic fluid to the pressure ports P of the spool valve 141 and the cam valves 142–143. Since the spool valve 141 is in its cross-over position, hydraulic fluid from the pump 101 is pumped through the valve 141 out its port B to the rod end of the valve cylinder 94. As a result, the cylinder rod 95 of the valve cylinder 94 is fully retracted and the slide valve 79 is shifted to its retracted position. In the retracted position of the slide valve 79, the roller D is cammed to shift the cam valve 143 to its straight position. It is noted that at this instant, the cam valves 142, 146 and 147 are all held in their cross-over positions. Further, the number 2 ports of both the cam valves 142 and 143 are blocked so that only the one of these valves which is cammed to its straight position can pass the hydraulic fluid delivered by the pump 101.

Since the cam valve 143 is shifted to its straight position, hydraulic fluid from the pump 101 is thus channeled by the valve 143 through its port 1 to the pressure port P of the cam valve 146. The cam valve 146 which is held in its cross-over position has its pressure port P in communication with its port 2 and a hydraulic pilot signal is supplied from the port 2 to shift the spool valve 108 to its straight position. The pilot signal from the port 2 of the cam valve 146 is also delivered to the pressure port of the cam valve 149. While the cam valve 149 could be at the instant of starting the pump in its straight or cross-over position, it is here assumed that the cam valve 149 is in its cross-over position. With the cam valve 149 in its cross-over position, the hydraulic fluid supplied to its pressure port P from the valve 146 is channeled to its port 2. Thereby, hydraulic pilot signals from the port 2 of the cam valve 149 pilot the valves 158 and 135 open and shift the spool valve 133 to its straight position.

The solenoids of the valves 111 and 115 are now energized by actuating switches (not numbered) on the control panel 21 to shift the valves 111 and 115 to their closed positions. Thereby, the relief valves 109 and 113 are no longer vented, become unbalanced and are shifted to their closed position. With the valves 109 and 113 closed, the hydraulic fluid pumped by the pumps 100 and 102 is delivered to pressure port P of the spool valve 108. It is noted that it is possible to operate the system using only one of the pumps 100 and 102, or that the manual valves 110 or 114 could be closed so that the valves 109 and 113, respectively, were no longer vented if one or both of the solenoid valves 111 and 115 failed to close.

Since the valve 108 has been piloted to its straight position, hydraulic fluid is delivered from its port A to the blind end of the piston cylinder 61. Thereby, rod of cylinder 61 is extended to extend its piston 53 to pump. As the rod of the piston cylinder 61 is extended, hydraulic fluid from its rod end is channeled by the spool valve 133, which is in its straight position, to the rod end of the sleeve cylinder 50'. The supplying of pressurized hydraulic fluid to the rod end of the sleeve cylinder 50' retracts its rod thereby to retract its concrete confining sleeve 41. The hydraulic fluid from the blind end of the sleeve cylinder 50' flows through the piloted open check valve 135 out the tank port T of the spool valve 133 to the reservoir 22.

It is noted that, as the sleeve cylinder 50' retracts its sleeve 41, the sleeve end 69 bears against the mechanical stop 55 to simultaneously retract its piston 53. This retraction of the piston 53 causes the cylinder rod of the piston cylinder 61' to be retracted. Consequently, hydraulic fluid flows from the blind end of the piston cylinder 61' through the piloted open valve 158 to fill the rod end of the cylinder 61'. The excess hydraulic fluid from the blind end of the piston cylinder 61' is returned to the reservoir 22 through the ports B and T of the spool valve 108 and the check valve 117.

Once the cylinder rod of the sleeve cylinder 50' has been fully retracted, the sleeves 41, pistons 53 and the slide valve 79 will be positioned relative to each other in the manner shown in FIG. 4. Full retraction of the sleeve 41 connected to the rod of the sleeve cylinder 50' cams the roller H to shift the cam valve 149 to its straight position. In its straight position, the cam valve 149 channels the pressurized hydraulic fluid received at its pressure port P to its outlet port 1 and its outlet port 2 is placed in communication with tank. Thereby, the hydraulic pilot signals formerly supplied to the valves 158 and 135 are removed so that the valve 158 is shifted closed and the check valve 135 is no longer piloted open and now prevents flow from the blind end of the sleeve piston 50'. Further, the hydraulic pilot signal from the outlet port 2 of the valve 149 is removed from the spool valve 133 while a hydraulic pilot signal is now supplied from the valve's outlet port 1 to shift the spool valve 133 to its cross-over position.

At the instant the spool valve 133 is shifted to its cross-over position, the rod of the piston cylinder 61 is still being extended. As a result, some hydraulic fluid from the rod end of the cylinder 61 is inadvertently channeled to the reservoir 22 by the spool valve 133 during its shift. For this reason and to compensate for other losses of hydraulic fluids, make up fluid is being supplied at a controlled rate to the pressure port P of the spool valve 133 from the B port of the spool valve 141.

The rod of the piston cylinder 61 is not fully extended at the time the spool valve 133 is shifted to its cross-over position, but rather, is only about half way extended and is still in the process of being extended by the hydraulic fluid pumped into its blind end through the spool valve 108. Consequently, hydraulic fluid is still being forced out of the rod end of the piston cylinder 61. With the spool valve 133 now in its cross-over position, the hydraulic fluid from the rod end of the cylinder 61 is channeled from the pressure port P of the valve 133 out its outlet port B through the check valve 135 to the blind end of the sleeve cylinder 50'. Thereby, the rod of the sleeve cylinder 51' is re-extended to force its concrete sleeve 41 through the concrete charge in the hopper 19 so as to segregate and confine a charge of concrete in the extending sleeve 41. During the re-extension of the cylinder rod of the sleeve cylinder 50', the hydraulic fluid from its rod end is channeled through the ports A and T of the spool valve 133 to the reservoir 22.

It is noted that the hydraulic system of FIG. 17 is designed so that the rod of the sleeve cylinder 50' is fully extended, thereby to extend its sleeve 41, prior to the full extension of the rod of the piston cylinder 61. This insures that the sleeve 41 associated with the sleeve cylinder 50' is fully extended prior to the time the piston 53 associated with the piston cylinder 61 bottoms out, i.e., is fully extended. As a consequence of the fact that the rod of the sleeve cylinder 50' is fully extended prior to the rod of the piston cylinder 61, a manner of disposing of the additional hydraulic fluid forced from the rod end of the cylinder 61 is provided in the form of an internally piloted relief valve 136. The valve 136 maintains the pressure on the blind end of the sleeve cylinder 50'0 at a predetermined level to hold its sleeve 41 fully extended and bleeds off excessive hydraulic fluid from the B port of the spool valve 133 to the reservoir 22.

Once the cylinder rod of the piston cylinder 61 has been fully extended, its piston 53 is also fully extended and cams the roller E to shift the cam valve 146 to its straight position. In the valve's straight position, the hydraulic fluid supplied to the pressure port P of the valve 146 is channeled to its outlet port 1 while its outlet port 2 is placed in communication with the hydraulic reservoir 22 through tank port T. As a consequence, the hydraulic pilot signals formerly supplied from the port 2 of the cam valve 146 to shift the spool valve 141 to its cross-over position and to the pressure port P of the cam valve 149 are removed, and hydraulic pilot signals are now supplied from the outlet port 1 of the valve 146 to shift the spool valve 141 to its straight position and simultaneously hydraulically return the cam valve 149 to its cross-over position.

With the spool valve 141 shifted to its straight position, hydraulic fluid is channeled out the A port of the valve 141 to the blind end of the valve cylinder 94. Thereby, the rod of the valve cylinder 94 is extended to shift the slide valve 79 from its retracted position to its extended position. The sleeves 41, concrete pistons 53 and the slide valve 79 will thus be positioned relative to each other in the manner shown in FIG. 5.

Shifting of the slide valve 79 from its retracted position causes the cam valve 143 to be shifted by its spring to its cross-over position since the roller D will be no longer cammed. In the cross-over position of the cam valve 143, the hydraulic fluid supplied to its pressure port P is channeled to its outlet port 2, which is blocked, and its outlet port 1 is connected through tank port T to the reservoir 22. Thus, the cam valve 143 when held in its cross-over position does not supply hydraulic fluid to the cam valve 146 so that the cam valves 146 and 149 cease to generate hydraulic pilot signals.

The shifting of the slide valve 79 to its extended position cams the roller C to shift the cam valve 142 to its straight position. With the cam valve 142 in the straight position, hydraulic fluid is channeled from its pressure port P to its outlet port 1, thereby hydraulic fluid is supplied from the outlet port 1 of the cam valve 142 to the pressure port P of the cam valve 147. Since the cam valve 147 is in its cross-over position, hydraulic fluid is channeled to the outlet port 2 of the valve 147. Thus, a hydraulic pilot signal is supplied from the port 2 of the valve 147 to shift the spool valve 108 to its cross-over position and hydraulic fluid is supplied to the pressure port P of the cam valve 148. The cam valve 148, which is in its cross-over position, supplies hydraulic pilot signals to pilot open the valve 160 and the check valve 137 and shifts the spool valve 134 to its straight position.

With the spool valve 108 shifted to its cross-over position, pressurized hydraulic fluid is supplied to the blind end of the piston cylinder 61' to extend its piston 53. Extension of the rod of the piston cylinder 61' and its piston 53 cause concrete to be pumped from the concrete sleeve 41 connected to the sleeve cylinder 50' and also forces hydraulic fluid from the blind end of the cylinder 61' to the pressure port P of the valve 134. Since the valve 134 is piloted to its straight position, hydraulic fluid is channeled to the rod end of the sleeve cylinder 50. Thereby, the sleeve cylinder 50 is fully retracted so that the sleeves 41, concrete pistons 53 and the slide valve 79 are positioned relative to each other as shown in FIG. 6. It is noted that the piloted open valves 160 and 137 function in the same manner as the earlier described valves 158 and 135, respectively, to permit the full retraction of the rods of the piston cylinder 61 and the sleeve cylinder 50.

Full retraction of the rod of the sleeve cylinder 50 fully retracts its sleeve 41 and consequently, the roller G is cammed by its retracted sleeve 41. The camming of the roller G shifts the cam valve 148 to its straight position. The cam valve 148 functions in a manner similar to the earlier described cam valve 149. The shifting of the cam valve 148 to its straight position causes the spool valve 134 to be shifted to its cross-over position and removes the hydraulic pilot signals from the valves 137 and 160 so that these valves close. With the spool valve 134 shifted to its cross-over position, the rod of the sleeve cylinder 50 is re-extended to re-extend its sleeve 41 into the hopper 19 to receive another charge of concrete mix.

Any excess hydraulic fluid supplied to the pressure port P of the spool valve 134 during the extension of the rod of the sleeve cylinder 50, whether forced from the blind end of the piston cylinder 61' or supplied as make up fluid from the A port of the spool valve 141, is bled to tank by an internally piloted relief valve 138. The relief valve 138 communicates with the B port of the spool valve 134. Once the cylinder rod of the piston cylinder 61'has been fully extended to fully extend its piston 53, the roller F is cammed to shift the cam valve 147 to its straight position. The cam valve 147 functions in a similar manner to the earlier described cam valve 146 and in its straight position pilots the spool valve 141 and the cam valve 148 back to their cross-over positions.

Thus, a complete cycle of the operation of the exemplary concrete pumping apparatus 11 has been described wherein the concrete confining sleeves 41 and pistons 53 have been selectively extended and retracted in the sequential manner illustrated in FIGS. 4–6 to first segregate charges of plastic concrete within the sleeves 41 and then pump these charges through the discharge nozzle 81 of the slide valve 79 into the flexible hose 93. It is noted that while the slide valve assembly 79 is employed in the exemplary apparatus for controlling the pumping of concrete out of the two sliding sleeve-piston combinations that the slide valve could be modified for use with a single sliding sleeve-piston combination or for use with more than two such sliding sleeve-piston combinations. Further, the hydraulic control system could be designed for controlling the operation of such modified concrete pumping systems.

As beforementioned, the pump 103 is also included in the hydraulic system of FIG. 17. The pump 103 draws hydraulic fluid from the reservoir 22 through the strainer 106 and operates to supply pressurized hydraulic fluid to a four section stack valve. The stack valve includes valves 122–125 and an internally piloted relief valve 128. The relief valve 128 is normally held in a closed position by a spring and communicates with the pressure side of the pump 103. The relief valve 128 operates to relieve pressure above a predetermined level built up on the pressure side of the pump 103 by bleeding excess hydraulic fluid to the reservoir 22. A pressure gauge 126 is included which measures and thereby monitors the pressure of the hydraulic fluid being supplied to the stack valve.

The valves 122–125 which each make up a section of the stack valve are all three position spool valves having straight, center and cross-over positions. The valves 122–124 are further each manual valves and are each shifted by manually shifting a lever (not shown) at the control panel 21. The pressure and tanks ports of the valves 122–125 are identified by the letters P and T, respectively, and their outlet or cylinder ports are identified by the letters A and B.

The stack valve is arranged so that hydraulic fluid is pumped by the pump 103 to the pressure port P of the spool valve 122. The spool valve 122 has a detent (not shown) so that it may be locked in its straight or its cross-over position. The valve 122 when shifted to its straight position supplies pressurized hydraulic fluid from its A port to drive the hydraulic motor 127 in one direction, thereby to rotate the blades 31 in the concrete hopper 19. Shifting the valve 122 to its cross-over position connects its pressure port P with its outlet port B so that the direction that the hydraulic motor 127 and the blades 31 are driven is reversed. The valve 122 channels the hydraulic fluid from its tank port T to the pressure port P of the spool valve 123. The valve 122 when shifted to its center position has its tank and pressure ports T and P in communication so that hydraulic fluid is supplied to the pressure port P of the spool valve 123 regardless of whether the valve 123 is in its straight, center or cross-over position.

The spool valve 123 has a detent (not shown) like the spool valve 122 so that the spool valve 123 may be locked in its straight or cross-over position. In its straight position, the spool valve 123 supplies pressurized hydraulic fluid from its outlet port A to one side of a hydraulic motor 129. The other side of the motor 129 is connected to the reservoir 22 so that the hydraulic fluid flow from the A port of the valve 123 through the hydraulic motor 129 to the reservoir 22. Thereby, the motor 129 is driven. The motor 129 is connected to a water pump (not shown) which operates to draw water from the water tanks 24 of the apparatus 11. This pumped water may be sprayed about and used for clean up purposes.

The spool valve 123 channels hydraulic fluid to its B port in its cross-over position. The hydraulic fluid flows from its B port through sequentially a hydraulic motor 130 which drives a heat exchanger fan, a heat exchanger or oil cooler 131, and a filter 132 to the reservoir 22. The hydraulic fluid is generally selectively pumped through this cooling-filtering system whenever the temperature of the fluid reaches a certain level. The valve 123 has its pressure and tank ports P and T in communication in its center position so that the hydraulic fluid received at its pressure port P is channeled out the tank port T to the pressure port P of the spool valve 124 when the valve 123 is shifted to its center position.

The spool valves 124 and 125 are both spring centered spool valves having their pressure and tank ports P and T in communication with each other in their center position. The spool valves 124 and 125 operate to selectively retract or extend the rods of the sleeve cylinders 50 and 50', respectively. The spool valve 124 when shifted to its straight position channels hydraulic fluid from its outlet port A to the blind end of sleeve cylinder 50 to extend its cylinder rod and the sleeve 41 connected thereto. In its cross-over position, the spool valve 124 channels the hydraulic fluid from its outlet port B to the rod end of the sleeve cylinder 50 to retract its rod and sleeve 41. The spool valve 125 receives pressurized hydraulic fluid at its pressure port P from the tank port P of the valve 124. The spool valve 125 operates in the same manner as the valve 124 to extend the rod of the sleeve cylinder 50' in its straight position and retract the cylinder rod in its cross-over position. The tank port T of the spool valve 125 is connected in communication with the reservoir 22 so that hydraulic fluid flowing through all the valves 122–125 is returned to tank.

This auxiliary manner for retracting one of the sleeves 41 by manually shifting one of the spool valves 124 or 125 to its cross-over position is provided in the hydraulic system so that line pressure resulting from restrictions in the discharge nozzle 81 and/or hose 93 may be relieved without disconnecting the hose 93. As beforementioned, when a concrete confining sleeve 41 is retracted it will automatically retract its piston 53, if the piston is fully or partially extended, the instant the sleeve end 69 contacts the mechanical stop 55 connected to the piston 53. Further, since the sleeve 41 to be retracted will most probably be one in which its piston 53 is in the process of being extended, it is essential that provision be made in the hydraulic circuit to permit the extending piston 53 to be retracted. Accordingly, a solenoid operated valve 180 is connected in communication with the pressure port P of the spool valve 108. The valve 180 is a normally open type solenoid valve which is held by a spring in its open position. The solenoid of the valve 180 may be energized to shift the valve to a closed position, thereby to close the hydraulic path between the pressure port P of the valve 108 and the reservoir 22. The solenoid of the valve 180 is energized at the instant of commencing the operation of the apparatus 11 and is maintained energized until it is desired to retract sleeve 41 to relieve line pressure. At that instant, the solenoid of the valve 180 is de-energized so that the valve 180 is shifted to its open position. Since the blind end of a piston cylinder whose rod is being extended is always connected in communication with the pressure port P of the valve 108, a hydraulic path is thus provided by the open valve 180 which permits hydraulic fluid from the blind end of the piston cylinder to return to tank. Thus, the rod of the piston 53 may be retracted as its sleeve is retracted to relieve built up pressure.

Although I have herein shown and described my invention in what I have conceived to be the most practical and preferred embodiment, it is recognized that departures may be made therefrom within the scope of my invention.

I claim:

1. A concrete pumping apparatus, comprising:

a concrete hopper including a discharge end, said hopper having a plurality of longitudinally extending channels defined in its bottom portion to collect plastic concrete supplied to said hopper, said discharge end having a discharge outlet in communication with each of said channels;

slide valve means mounted on said discharge end of said hopper for controlling the discharge of concrete from said discharge outlets, said slide valve means including a fixed wear plate mounted on said hopper discharge end and a movable wear plate, said fixed wear plate having openings aligned with said discharge outlets and said movable wear plate having an opening for selective alignment with said openings in said fixed wear plate, said fixed and movable wear plates having planar wear faces that make sliding contact with each other in a predetermined plane of contact whereby selectively shifting said movable wear plate with respect to said fixed wear plate the discharge of concrete from said discharge outlets may be controlled;

concrete confining sleeves mounted in each of said channels for reciprocating movement along the axes of said channels, each of said concrete confining sleeves having a discharge end that lies in a given plane so that the sleeve discharge ends may be positioned in the plane of contact of the wear surfaces of said wear plates, each of said concrete confining sleeves being movable between a retracted position where it is substantially withdrawn from said hopper and a fully extended position where it communicates with one of said discharge outlets and has its discharge end positioned in the plane of contact of the wear surfaces of said wear plates, said sleeves being operable during their extension through plastic concrete in said hopper to receive and confine concrete therein;

concrete-pumping pistons mounted within each of said sleeves for reciprocating movement therein, each of said pistons including a flat concrete-contacting face and being movable from a retracted position to a fully extended position within its respective sleeve so that said flat piston face is in the plane of its associated sleeve end, whereby said piston and sleeve ends may both be positioned in the plane of contact of the wear faces of said wear plates; and control means connected to said movable wear plate, to said sleeves and to said pistons for selectively programming the movement of said sleeves and pistons and effecting the shifting of said movable wear plate so that whenever said concrete pumping apparatus is operated plastic concrete within said hopper is received in and pumped out of said sleeves through said slide valve means sequentially through each of said discharge outlets.

2. A concrete pumping apparatus, comprising: a concrete hopper having a discharge end wall, said discharge end wall including a plurality of discharge outlets extending therethrough; selectively actuatable pump means axially aligned with each of said discharge outlets, each pump means including a sleeve and a piston moveable axially through said hopper for pumping plastic concrete from said hopper out of the discharge outlet with which it is associated; slide valve means mounted externally of said hopper on the outer side of said discharge end wall of said hopper for controlling the discharge of concrete from said discharge outlets, said slide valve means including a discharge nozzle and a valving mechanism, said valving mechanism being formed by a pair of wear plates mounted in sliding contact with respect to each other in sealing relationship, said nozzle being carried by one of said wear plates; selectively operable positioning means connected to said wear plates for moving said one wear plate relative to the other to connect said discharge nozzle in communication with any selected one of said discharge outlets; and control means connected to said pump means and said positioning means for selectively operating said positioning means and actuating each of said pump means in a programmed sequence, whereby to coordinate the relative positioning of said wear plates and discharge nozzle with the selective operation of each of said pumping means so that whenever said concrete pumping apparatus is operated, plastic concrete within said hopper is pumped into said discharge nozzle sequentially from said sleeves through each of said discharge outlets.

3. A concrete pumping apparatus, comprising:

a concrete hopper including a discharge end, said hopper having a plurality of longitudinally extending channels in its bottom portion to collect plastic concrete supplied to said hopper, said discharge end having a discharge outlet in communication with each of said channels a concrete-confining sleeve associated with each of said channels, each of said sleeves being mounted for reciprocating movement along the longitudinal axis of the one of said channels with which it is associated from a retracted position where it is substantially withdrawn from said hopper to an extended position where said sleeve extends into the one of said discharge outlets with which it is associated, each of said sleeves being operable during its extension through plastic concrete within said hopper to receive and confine concrete therein;

sleeve driving means connected with each of said sleeves for selectively moving said sleeves between their retracted and extended positions;

a piston mounted within each of said sleeves piston driving means connected with each of said pistons for selectively extending said piston within the one of said sleeves with which it is associated to discharge concrete confined therein out of the associated one of said discharge outlets;

piston retracting means for retracting an extended one of said pistons whenever its associated sleeve is retracted;

a fixed wear plate mounted externally on said discharge end of said hopper and having openings in alignment with said discharge outlets;

a movable wear plate having a discharge opening therein and a discharge nozzle on one side thereof in communication with the opening therein;

low friction bearing means mounting and holding the other side of said movable wear plate in sliding contact with said fixed wear plate in sealing relationship thereto, whereby by selectively positioning said movable wear plate said discharge nozzle may be aligned and thereby connected in communication with any selected one of said discharge outlets in said fixed wear plate;

selectively operable positioning means connected to said movable wear plate for aligning said discharge nozzle in communication with any selected one of said discharge outlets; and control means connected to said sleeve driving means, to said piston driving means and to said positioning means for selectively operating said sleeve driving, piston driving and movable wear plate positioning means in a programmed sequence, whereby whenever said concrete pumping apparatus is operated plastic concrete within said hopper is pumped sequentially through said discharge outlets and out of said discharge nozzle.

4. In a concrete pumping apparatus wherein plastic concrete is pumped from a hopper by advancing a sleeve through said hopper to confine concrete therein and then advancing a piston through said sleeve to contact said concrete to pump said concrete out of said sleeve and through a discharge outlet in said hopper, the improvement of:

valve means for controlling the discharge of concrete from said hopper discharge outlet, said valve means including a fixed and a movable wear plate, said fixed wear plate having an opening and being mounted on said hopper so that said opening forms said hopper discharge outlet, said fixed and movable wear plates having planar wear faces which make sliding contact with each other in a predetermined plane of contact, said movable wear plate having an opening alignable with said opening in said fixed wear plate whereby by selectively shifting said movable wear plate with respect to said fixed wear plate the discharge of concrete from said discharge outlet may be controlled; and wherein the piston and sleeve have fully extended positions in which the concrete-contacting end of said piston and the discharge end of said sleeve are both positioned in the plane of contact of said wear faces.

5. A concrete pumping apparatus, comprising:

a concrete hopper including a discharge end, said hopper having first and second longitudinally extending channels defined in its bottom portion to collect plastic concrete supplied to said hopper, said discharge end having a discharge outlet in communication with each of said channels;

slide valve means mounted on said discharge end of said hopper for controlling the discharge of concrete from said discharge outlets, said slide valve means including a fixed wear plate mounted on said hopper discharge end and a movable wear plate, said fixed wear plate having openings aligned with said discharge outlets, and said movable wear plate having an opening for selective alignment with said openings in said fixed wear plate, said fixed and movable wear plates having planar wear faces that make sliding contact with each other in a predetermined plane of contact whereby by selectively shifting said movable wear plate with respect to said fixed wear plate the discharge of concrete from said discharge outlets may be controlled;

first and second concrete confining sleeve mounted for reciprocating movement along the axes of said first and second channels, respectively, each of said concrete confining sleeves having a discharge end that lies in a given plane so that the sleeve discharge ends may be positioned in the plane of contact of the wear surfaces of said wear plates, each of said concrete confining sleeves being movable between a retracted position where it is substantially withdrawn from said hopper to a fully extended position where it communicates with one of said discharge outlets and has its discharge end positioned in the plane of contact of the wear surfaces of said wear plates, said sleeves being operable during their extension through plastic concrete in said hopper to receive and confine concrete therein;

first and second concrete-pumping pistons mounted within said first and second sleeves, respectively, for reciprocating movement therein, each of said pistons including a flat concrete-contacting face and being movable from a retracted position where it is substantially withdrawn from said hopper to a fully extended position within its respective sleeve so that said flat piston face is in the plane of its associated sleeve end, whereby said piston and sleeve ends may both be positioned in the plane of contact of the wear faces of said wear plates; and control means connected to said movable wear plate, to said sleeves and to said pistons for selectively programming the movement of said sleeves and pistons and effecting the shifting of said movable wear plate so that whenever said concrete pumping apparatus is operated plastic concrete within said hopper is received in and pumped out of said sleeves through said slide valve means sequentially through each of said discharge outlets.

6. The apparatus recited in claim 5, wherein said control means is a hydraulic control system that includes cam valves that are individually cammed by the movement of said sleeves, said pistons and the shifting of said movable wear plate, whereby to program the operation of said concrete pumping apparatus.

7. The apparatus defined in claim 5, wherein said slide valve means includes a discharge nozzle and a conduit connected to said discharge nozzle for conducting pumped concrete to a remote location.

8. The apparatus defined in claim 5, including resilient material secured in each of said channels which is compressed by the extension of said sleeves into said channels so as to wipe against the lower surface of said sleeves and thereby prevent the accumulation of concrete under said sleeves.

9. The apparatus defined in claim 5, including rotatable blade means mounted in said hopper for displacing plastic concrete in said hopper into said hopper channels; and means for rotating said blade means.

10. The apparatus defined in claim 5, including mounting means holding said movable wear plate under pressure against said fixed wear plate so that a seal is formed between the wear faces of said wear plates.

11. The apparatus defined in claim 10, including adjustable pressure applying means for adjusting the pressure at which said movable wear plate is held against said fixed wear plate so as to compensate for wear.

12. The apparatus defined in claim 5, wherein said control means includes hydraulic cylinder means for selectively extending and retracting said sleeves and for selectively extending and retracting said pistons, and including stop means connected to said pistons and engageable by an end of said sleeves to limit the extension of said pistons into said sleeves and cause said pistons to be retracted simultaneously with the retraction of said sleeves.

13. The apparatus defined in claim 12, wherein the hydraulic cylinder means for extending said pistons have longer strokes than the hydraulic cylinder means for extending said sleeves so that plastic concrete within said discharge outlets is moved out of the path of said sleeve discharge ends and into said sleeves as said sleeves are extended into said discharge outlets, and including means for adjusting the distance said sleeves and said pistons are extended to compensate for wear of said sleeve discharge ends.

14. Concrete pumping apparatus, comprising:

a hopper for receiving a concrete mix, said hopper having a bottom wall, opposed end walls and upwardly and outwardly sloping side walls, said bottom wall including a plurality of parallel, semi-cylindrical channels, one of said end walls having a discharge outlet axially aligned with each of said channels;

valve means mounted upon said one end wall including a fixed wear plate having an opening axially aligned with each of said discharge outlets, a movable wear plate slidably engaged with said fixed wear plate and having an opening selectively positionable in axial alignment with one of said discharge outlets, a discharge nozzle mounted for movement with said movable wear plate and communicating with said opening in said movable wear plate, and means for shifting said movable wear plate and discharge nozzle relative to said fixed wear plate to selectively allow discharge of concrete mix through said hopper discharge outlets;

a cylindrical sleeve mounted for reciprocating movement along each of said semi-cylindrical channels from a retracted position wherein the discharge end thereof is substantially withdrawn from said hopper to a fully extended position where it is received in its associated discharge outlet and has its discharge end positioned in the plane of contact of the wear surfaces of said wear plates;

a piston slidably mounted in each of said cylindrical sleeves operable to eject concrete confined therein, each of said pistons having a concrete-contacting face that lies in the plane of contact of the wear surfaces of said wear plates when the pistons are in their fully extended position; and means connected with said cylindrical sleeves and pistons and operable in timed relation with said movable wear plate shifting means for operating the same in sequence to effect pumping of concrete mix from said hopper.

15. Apparatus as defined in claim 14, including means maintaining the wear plates in engagement under uniform pressure to compensate for wear of the contacting faces of said wear plates.

16. Apparatus as defined in claim 14, wherein each cylindrical sleeve has a wear ring adjustably mounted on its discharge end to compensate for wear, whereby said discharge end will lie in the plane of contact of said wear faces when the cylindrical sleeves are fully extended.

17. Apparatus as defined in claim 14, including means for adjusting the stroke of the pistons to compensate for wear on the concrete-contacting face of said pistons, whereby said face of said pistons will be in the plane of contact of the wear faces of said wear plates when the pistons are fully extended.

18. The method of pumping a concrete mix from a hopper containing the concrete mix and having a discharge outlet, comprising the steps of:

blocking said discharge outlet at its outer edge to prevent the discharge of concrete therethrough;

moving a hollow member into said hopper and through said concrete mix to a point where its advancing edge is flush with the outer edge of said discharge outlet to thereby isolate a portion of said concrete mix and confine it in said hollow member;

discontinuing the blocking of said discharge outlet; and ejecting the confined concrete mix from said hollow member through said discharge outlet.

19. The method defined in claim 18, wherein the confined concrete mix is ejected from said hollow member by moving a solid member longitudinally through said hollow member until the concrete-contacting face of said solid member is flush with the outer edge of said discharge outlet.

20. The method defined in claim 19, including the step of simultaneously retracting said hollow and solid members from the concrete mix remaining in said hopper.

21. The method defined in claim 20, including the step of forcing a portion of said remaining concrete mix into the vacant space produced therein as the hollow member is retracted.

* * * * *

UNITED STATES PATENT AND TRADEMARK OFFICE

CERTIFICATE OF CORRECTION

PATENT NO. : 4,036,564

DATED : July 19, 1977

INVENTOR(S) : John A. Richards

It is certified that error appears in the above-identified patent and that said Letters Patent are hereby corrected as shown below:

Col. 1, line 33, change "have", second occurrence, to -- been --.

Col. 3, line 5, change "form" to -- from --.

Col. 3, line 14, change "plastics" to -- plastic --.

Col. 15, line 19, change " 50'0 " to -- 50' --.

Col. 21, line 58, change "sleeve" to -- sleeves --.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*